US008746794B2

(12) United States Patent
Oren et al.

(10) Patent No.: US 8,746,794 B2
(45) Date of Patent: Jun. 10, 2014

(54) INFANT BOUNCER

(75) Inventors: Shoshana Oren, Tel Aviv (IL); Hagai Harduff, Binyaminia (IL); Amit Avigdor, Nitzaney Oz (IL); Giora Shachal, Tel Aviv (IL)

(73) Assignee: Tiny Love Ltd., Tel Aviv (IL)

( * ) Notice: Subject to any disclaimer, the term of this patent is extended or adjusted under 35 U.S.C. 154(b) by 39 days.

(21) Appl. No.: 13/419,976

(22) Filed: Mar. 14, 2012

(65) Prior Publication Data

US 2012/0235450 A1 Sep. 20, 2012

Related U.S. Application Data

(60) Provisional application No. 61/452,415, filed on Mar. 14, 2011.

(51) Int. Cl.
*A47D 13/10* (2006.01)
*A63G 9/00* (2006.01)

(52) U.S. Cl.
USPC ..... 297/274; 297/118; 297/130; 297/256.16; 297/258.1; 297/271.6; 297/354.12; 297/354.13

(58) Field of Classification Search
USPC ..... 297/250.1–256.16, 274, 354.12, 297/354.13, 118, 130, 258.1, 271.6
See application file for complete search history.

(56) References Cited

U.S. PATENT DOCUMENTS 3,124,388 A * 3/1964 Berlin ..... 297/320
3,359,035 A * 12/1967 Schiffman ..... 297/317
4,019,751 A 4/1977 Nakao
4,553,786 A 11/1985 Lockett, III et al.
4,762,364 A * 8/1988 Young ..... 297/256.12
D297,685 S 9/1988 Wilson
4,998,307 A * 3/1991 Cone ..... 297/256.13 X
5,092,004 A * 3/1992 Cone et al. ..... 297/118 X
5,187,826 A 2/1993 Mariol
5,201,535 A * 4/1993 Kato et al. ..... 297/130 X
D337,894 S 8/1993 Mariol
5,431,478 A * 7/1995 Noonan ..... 297/130
5,947,552 A * 9/1999 Wilkins et al. ..... 297/16.1
6,196,629 B1 * 3/2001 Onishi et al. ..... 297/256.12
D440,412 S 4/2001 Huang
6,257,659 B1 * 7/2001 Wilkins et al. ..... 297/16.1
D447,879 S 9/2001 Hsia
6,341,818 B1 1/2002 Verbovszky et al.
6,592,425 B2 7/2003 Bapst et al.
6,594,840 B2 7/2003 Tomas et al.
D478,220 S 8/2003 Chang (Continued)

FOREIGN PATENT DOCUMENTS

CN 1676061 10/2005
CN 1676063 10/2005

(Continued)

*Primary Examiner* — Rodney B White
(74) *Attorney, Agent, or Firm* — Dorsey & Whitney LLP

(57) ABSTRACT

An infant seat comprising an upper torso support, a lower torso support pivotally articulated to the upper torso support and a seat supporting structure; at least one of the upper torso support or the lower torso support is pivotally articulated to the seat supporting structure, the seat further comprising a converting mechanism for converting the seat between at least an angular position in which the upper torso support is inclined with respect to the lower torso support, and a planar position in which the upper torso support and the lower torso support are substantially co-planar.

18 Claims, 22 Drawing Sheets

(56) References Cited

U.S. PATENT DOCUMENTS

| | | | | |
|---|---|---|---|---|
| 6,629,727 | B2 | 10/2003 | Asbach et al. | |
| 6,679,552 | B1 * | 1/2004 | Kassai | 297/250.1 |
| 6,773,065 | B1 * | 8/2004 | Stamper | 297/256.12 |
| 6,851,745 | B2 * | 2/2005 | nee Wilkins et al. | 297/16.1 |
| 7,008,018 | B2 * | 3/2006 | Chen | 297/363 |
| 7,073,859 | B1 * | 7/2006 | Wilson | 297/256.1 |
| 7,219,959 | B2 * | 5/2007 | Ransil et al. | 297/354.12 X |
| 7,364,235 | B2 * | 4/2008 | Chen et al. | 297/354.12 X |
| 7,407,232 | B2 | 8/2008 | Sakamoto et al. | |
| 7,455,353 | B2 * | 11/2008 | Favorito (nee Wilkins) et al. | 297/16.1 |
| 7,475,942 | B2 * | 1/2009 | Boyle et al. | 297/274 X |
| 7,497,518 | B2 * | 3/2009 | Fritz et al. | 297/354.12 |
| 7,510,242 | B2 | 3/2009 | Yumoto et al. | |
| D604,055 | S | 11/2009 | Plested et al. | |
| 7,722,118 | B2 * | 5/2010 | Bapst et al. | 297/256.12 |
| D655,518 | S | 3/2012 | Sclare | |
| 8,251,446 | B1 * | 8/2012 | Guerrido | 297/256.1 |
| 8,348,340 | B2 | 1/2013 | Ohnishi | |
| 8,439,765 | B2 * | 5/2013 | Barron et al. | 472/118 |
| 2002/0002741 | A1 | 1/2002 | Tomas et al. | |
| 2003/0020317 | A1 | 1/2003 | Keegan et al. | |
| 2005/0241064 | A1 | 11/2005 | Lopes et al. | |
| 2006/0012230 | A1 * | 1/2006 | Kennedy et al. | 297/274 X |
| 2009/0033133 | A1 * | 2/2009 | Barron et al. | 297/274 |
| 2009/0181780 | A1 * | 7/2009 | Myers et al. | 297/274 X |

FOREIGN PATENT DOCUMENTS

| | | |
|---|---|---|
| CN | 1876433 | 12/2006 |
| CN | 1937940 | 3/2007 |
| CN | 201005347 | 1/2008 |
| CN | 101744464 | 6/2010 |
| CN | 201825082 | 5/2011 |
| CN | 102078103 | 6/2011 |
| CN | 201888556 | 7/2011 |
| DE | 102009034552 | 2/2011 |
| WO | WO 99/08572 | 2/1999 |

* cited by examiner

INFANT BOUNCER

CROSS-REFERENCE TO RELATED APPLICATIONS

This application claims priority to U.S. Provisional Application No. 61/452,415 filed on 14 Mar. 2011, the disclosure of which is incorporated herein, in its entirety, by this reference.

TECHNICAL FIELD

This presently disclosed subject matter relates to infant seats. More particularly, the presently disclosed subject matter is directed to infant seats convertible between several positions, and which can be used as infant cradles or rockers.

BACKGROUND

Some examples of convertible bouncers and cradles are disclosed in WO 1999/08572, US 2005/0241064 and U.S. Pat. No. 6,594,840.

SUMMARY

According to the disclosed subject matter there is provided an infant seat comprising an upper torso support, a lower torso support pivotally articulated to the upper torso support, and a seat supporting structure; at least one of the upper torso support and the lower torso support is pivotally articulated to the seat supporting structure; the seat further comprising a converting mechanism for converting the seat between at least an angular position in which the upper torso support is inclined with respect to the lower torso support, and a planar position in which the upper torso support and the lower torso support are substantially co-planar.

The seat can constitute, for example, part of a bouncer, a chair, a car safe seat, a swing, a stroller, or a plane seat/bassinet, all can be stationary or portable.

The term 'angular position' refers to a position of the seat in which an angle between the upper torso support and the lower torso support is less than 180°, while the term 'planar position' refers to a position of the seat in which the upper torso support and the lower torso support extend substantially co-planar in a substantially horizontal plane or inclined with respect to the ground.

The seat supporting structure is a fixed structure, i.e. comprise elements which devoid of movement at least with respect to each other, while the upper torso support and the lower torso support are a non-stationary structure, i.e., configured for sliding displacement at least in one direction with respect to the seat supporting structure.

The term 'sliding displacement' refers to linear displacement, pivotal displacement or a combination thereof.

The upper torso support is configured for pivotal displacement with respect to the seat supporting structure causing thereby sliding of the lower torso support with respect to the seat supporting structure, due to the pivotal articulation between the upper torso support and the lower torso support.

The upper torso support can engage the lower torso support by pivotal articulation therebetween.

Due to the displacement of the lower torso support with respect to the upper torso support and the displacement of the upper torso support with respect to the seat supporting structure, the seat is relatively smoothly converted between its different positions. This is especially useful when an infant occupying the seat falls asleep and the seat has to be converted into its planar position without waking up the infant.

The converting mechanism can be at least partially embedded in a portion of the seat or can be a separate assembly associated with the seat.

The converting mechanism can be configured for defining a plurality of discrete positions each of which being associated with one of the positions of the seat. In particular, the converting mechanism can comprise a first portion associated with the upper torso support and a second portion fixed to the seat supporting structure, the first portion configured to be slidingly displaced with respect to the second portion when the seat is converted between its different positions.

More particularly, the first portion can be a handle lever slidingly received within the upper torso support, and the second portion can be a housing fixedly attached to the seat supporting structure. The upper torso support can be formed with a receiving channel extending longitudinally along at least a portion thereof and configured for slidingly receiving therein the handle lever. The handle lever can be associated with a locking mechanism configured for arresting the seat in one of its positions, preventing the seat from unintentionally converting to another position.

The locking mechanism can comprise a pair of locking pins and a plurality of pairs of recesses within the housing, each pair of recesses configured for arresting the pair of the locking pins, so that when the pins are spaced from the recesses the handle lever can be displaced along the receiving channel and the upper torso support can be slidingly displaced with respect to the seat supporting structure, and when the seat is brought to the desired position the pins are released to be arrested within a corresponding pair of recesses associated said desired position of the seat.

The above arrangement allows converting the seat between its different positions by first slidingly displacing the handle lever along the receiving channel of the upper torso support so as to release the locking mechanism and then pivotally/slidingly displacing the upper torso support with respect to the seat supporting structure so as to bring the seat to the desired position.

The upper torso support comprises two pivoting brackets articulated thereto and in turn pivotally attached to the seat supporting structure, so as to allow pivotal displacement of the upper torso support with respect to the seat supporting structure.

The upper torso support can be a rigid structure or can comprise a firm though flexible portion, comprising, for example, a plurality of flexible ribs. At least when comprising a flexible portion, the upper torso support can be provided with a back support, so that the upper torso support can be leaned against the back support when the seat is in its planar position, decreasing thereby the flexibility of the flexible support system and increasing the rigidity thereof.

The above arrangement, allows the seat according to the presently disclosed subject matter, to serve as a cradle in its planar position, as the upper torso support and the lower torso support constitute a co-extending firm, flat base. This position allowing a lie-flat position of the infant over the seat, known as aiding newborns development by promoting lung development, assisting breathing, aiding spine growth and strengthen muscle tone, providing neck control and in later stages enabling exploring his own hands and feet and encouraging movement following.

The lower torso support can be provided with a limiting arrangement configured for limiting the sliding displacement of the lower torso support with respect to the seat supporting structure.

The lower torso support can be a rigid structure made of a material similar to that of the upper torso support. Alternatively, the upper torso support can be at least partially made of a material different from that of the lower torso support.

The seat can further comprise a fabric frame assembly, typically configured to be detachably attached thereto. In particular, the fabric frame assembly can comprise a front fabric frame configured to be displaced in correspondence to the displacement of the upper torso support with respect to the seat supporting structure and a rear fabric frame stationary with respect to the seat supporting structure.

The fabric frame assembly can be spaced from the upper and the lower torso support at least when the seat is in its planar position, so that when a fabric cover is fitted over the fabric frame assembly the fabric cover can constitute bassinet walls wrapping the seat.

The seat can be configured for converting into one or more distinct angular positions, each defined by a different angle between the upper torso support and a lower torso support.

The seat can be detachably attached to a base structure, said base structure configured for providing the seat with a motion effect and a mechanism for controlling such effect, which can be any kind of bouncing, rocking and sliding effect and combinations of such reciprocal motion.

Such a base structure can constitute part of a bouncer, a chair, a car safe seat, a swing, a stroller or a plane seat/bassinet, all can be stationary or portable.

BRIEF DESCRIPTION OF THE DRAWINGS

In order to understand the presently disclosed subject matter and to see how it can be carried out in practice, embodiments will now be described, by way of non-limiting examples only, with reference to the accompanying drawings, in which.

DETAILED DESCRIPTION OF EMBODIMENTS

Attention is first directed to FIGS. 1A to 1E of the drawings illustrating an infant bouncer generally designated 100, comprising a seat generally designated 10, in several seat positions, i.e. a planar position (FIGS. 1A and 1E) and two angular positions (FIG. 1B and FIGS. 1C and 1D) and. It should be appreciated that although only three positions are shown, the seat 10 of the bouncer 100 can be configured in one or more additional angular positions and one or more additional substantially planar positions.

Figure 2A:
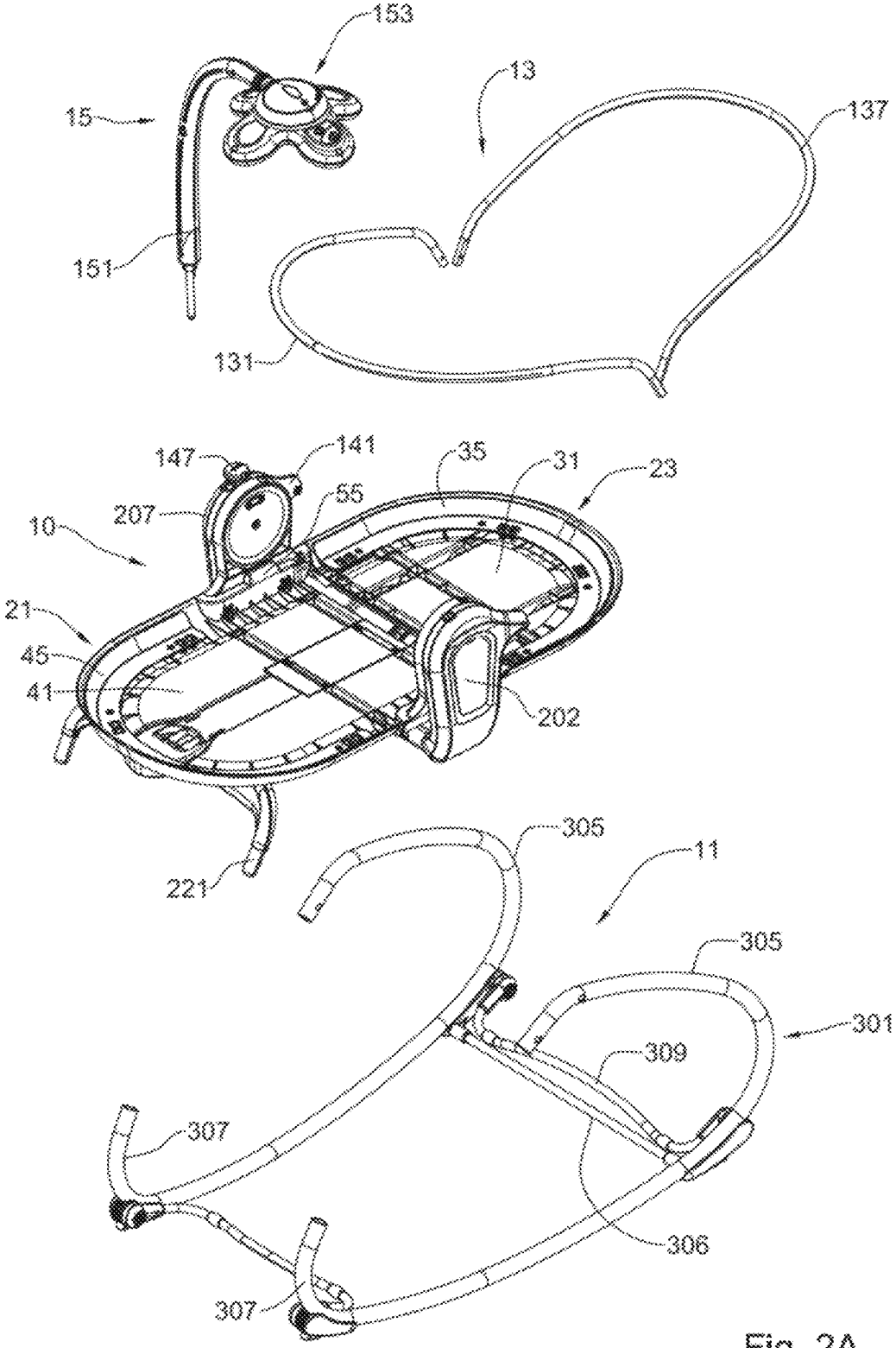
FIG. 2A is an exploded isometric view of the bouncer showing its four sub-assemblies.

With reference to FIG. 2A, the bouncer 100 is fitted with four main sub-assemblies: the seat generally designated 10, a fabric assembly generally designated 13, a base structure generally designated 11, and a toy assembly generally designated 15, each of which will be described in detail below.

The seat 10 (shown also in FIGS. 2A and 2B) comprises an upper torso support 21 and a lower torso support 23, a converting mechanism 25 (FIGS. 8 to 11) and a seat supporting structure 27 (FIG. 2C) configured for fixing the seat 10 to the base structure 11 or to any other seat carrying structure, e.g. suspended from a rocker arm articulated to a vehicle seat, etc.

It can be appreciated that the seat 10 comprises a non-stationary portion, i.e. elements that are linearly or pivotally displaceable with respect to the base structure 11, such as the upper torso support 21 and the lower torso support 23, and a stationary portion, i.e. elements that are stationary with respect to the base structure 11, such as the seat supporting structure 27.

As shown in FIGS. 2B, 2C and 3A to 4B, the supporting structure 27 comprises a U-like back supporting frame 201 (FIG. 2C) composed of a transverse portion 203 and two rods 205 fixedly attached to a back rest member 221, and two side supports 207. At the planar position of the seat 10 the back rest member 221 provides a point of contact with the upper torso support 21 (FIGS. 1A, 2A and 4B), increasing thereby the stability and the rigidity of thereof. The back supporting frame 201 is configured to be detachably attached to a housing 71 of the converting mechanism 25, and the back rest member 221 is configured to be detachably attached to the base structure 11.

The back supporting frame 201 can be a single uniform element, or the transverse portion 203 and the rods 205 can be separate elements fixedly attached so as to constitute the back supporting frame 201.

As can be seen best in FIGS. 2B to 8B, the upper and lower torso supports 21 and 23 are substantially U-like shaped with their respective bases 37 and 47 facing each other and with their longitudinal axis $A_1$ and $A_2$ (FIGS. 4A and 4B) extending coplanar (in all the positions of the seat 10) and coaxial in the planar position of the seat 10.

The upper torso support 21 and the lower torso support 23 are made of a substantially rigid material and each have a substantially flat top surface 31 and 41 (FIGS. 2A and 5A), respectively, with peripheral edges 35 and 45 elevated from the top surface 31 and 41 and bottom surface 33 and 43.

Figure 2B:
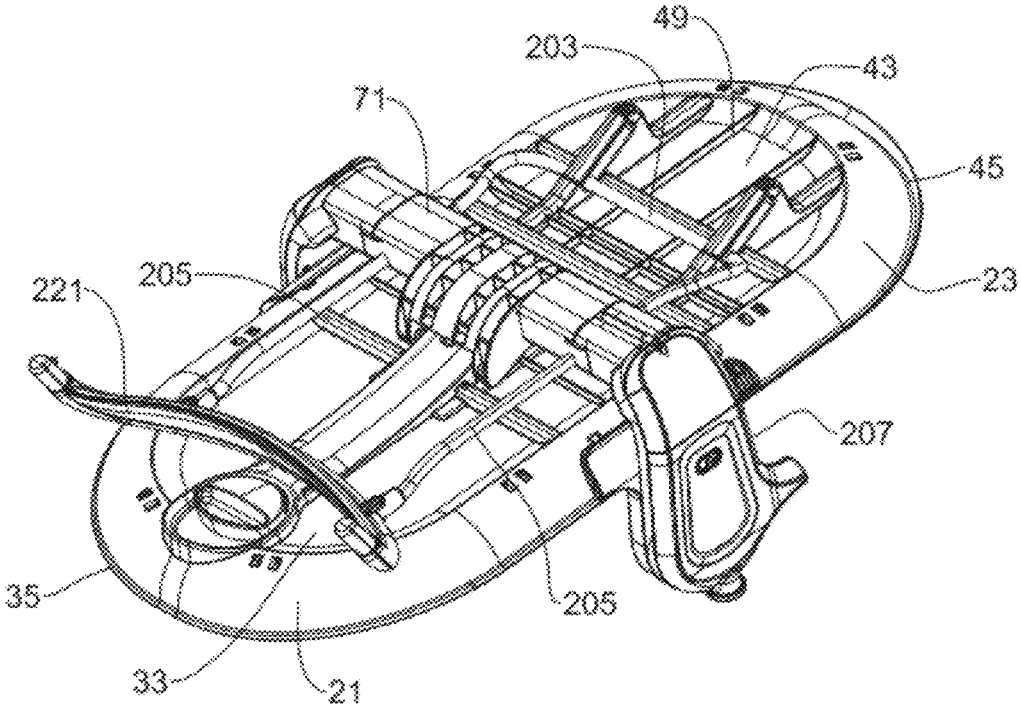
FIG. 2B is a bottom perspective view of the seat sub-assembly of the bouncer, shown in FIG. 2A.
Figure 2C:
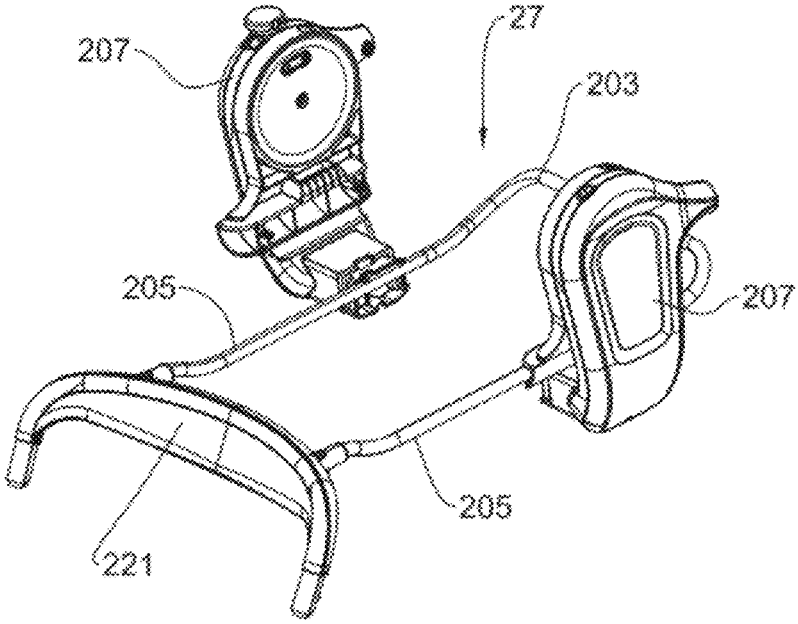
FIG. 2C is a perspective view of the seat supporting structure sub-assembly of the bouncer, shown in FIG. 2A.

The upper torso support 21 and the lower torso support 23 can be fitted with a plurality of reinforcing elements both on the front surfaces 31 and 41 (e.g. ribs 39 shown for example in FIGS. 5B and 7A) and on the bottom surfaces 33 and 43 (e.g. ribs 49 seen in FIG. 2B).

The upper torso support 21 and the lower torso support 23 can be further fitted with annular fabric arresting members 34 and 44 (FIGS. 3B and 5A), snappingly attachable to the top surfaces 31 and 41 so as to extend along the peripheral edges 35 and 45, and are configured for easily detaching the fabric cover 160, e.g. for washing purpose.

Figure 5A:
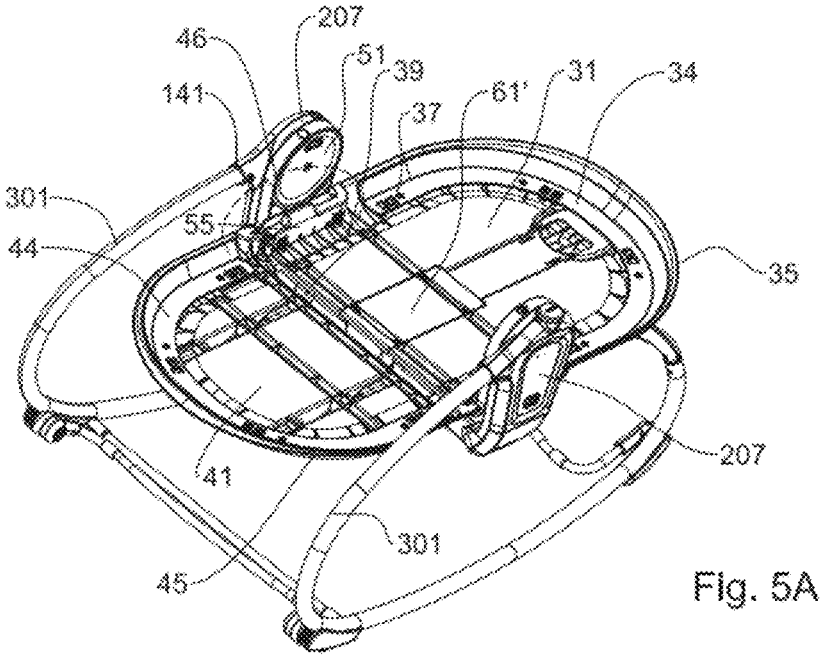
FIG. 5A is a top perspective view of the bouncer without the fabric assembly and the toy assembly.
Figure 5B:
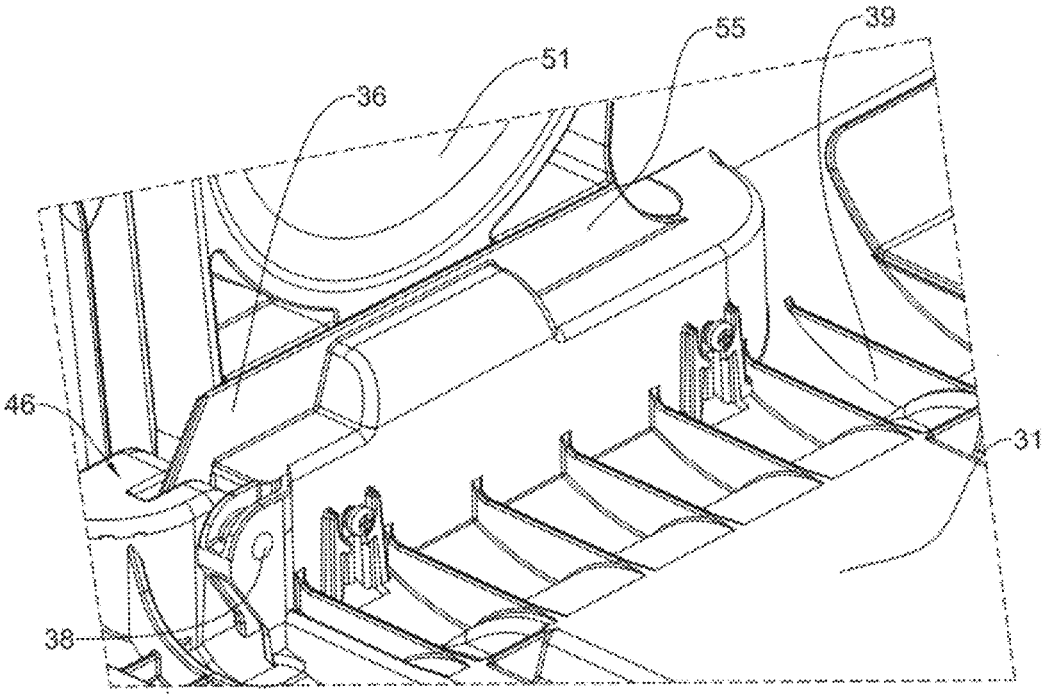
FIG. 5B is an enlargement of a dotted portion shown in FIG. 5A.

The upper torso support 21 and the lower torso support 23 are pivotally articulated one to the other at a pair of coaxial joints 46 (marked by a dotted circle in FIG. 5A and enlarged in FIG. 5B). In particular, the upper torso support 21 comprises a bifurcated portion 36 and the lower torso support 23 comprises a bifurcated portion 46 pivotally articulated to the bifurcated portion 36 by pivot locking pin (not shown) received within a pin receptacle 38.

The upper torso support 21 is further provided with a pair of pivoting brackets 51 each extending upwards at respective ends of the base 37 of the upper torso support 21, as further described in detail with reference to FIGS. 13 to 15, and configured for pivotally articulating to corresponding side supports 207 of the seat supporting structure 27.

The arrangement is such that when an external force is applied to the upper torso support 21 (as detailed below) the upper torso support pivots with respect to the seat supporting structure 27 together with the pivoting brackets 51. Due to the pivoting articulation between the upper torso support 21 and the lower torso support 23, the lower torso support 21 correspondingly displaces pivotally with respect to the upper torso support 21 and slidingly with respect to the seat supporting structure 27, allowing relatively smooth conversion between different positions of the seat 10.

Figure 7A:
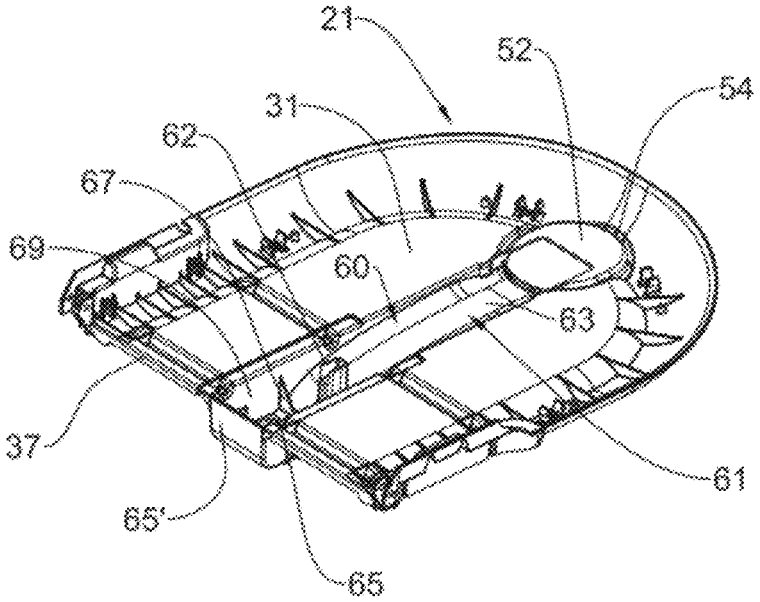
FIG. 7A is a top perspective view of the upper torso support of the bouncer.
Figure 7B:
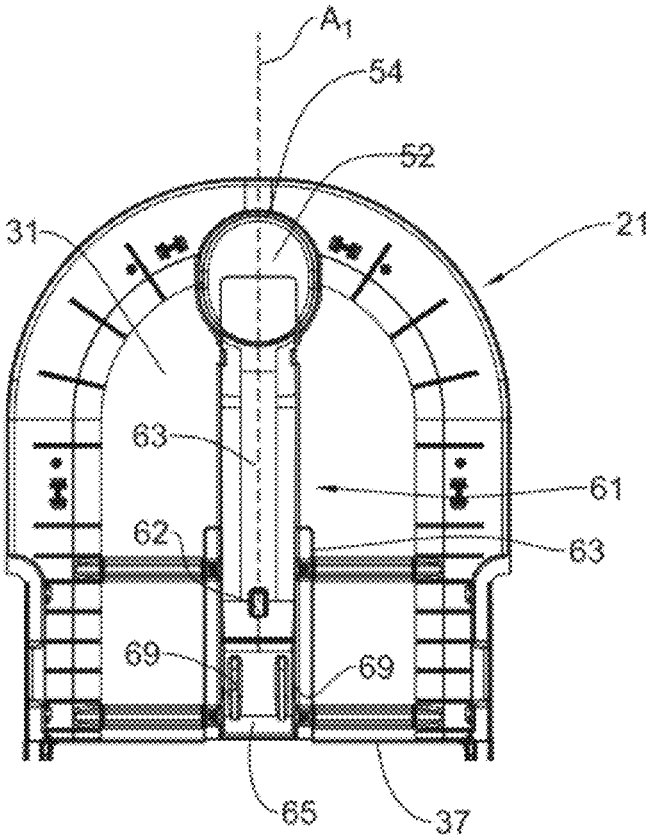
FIG. 7B is a top view of the upper torso support of the bouncer.
Figure 7C:
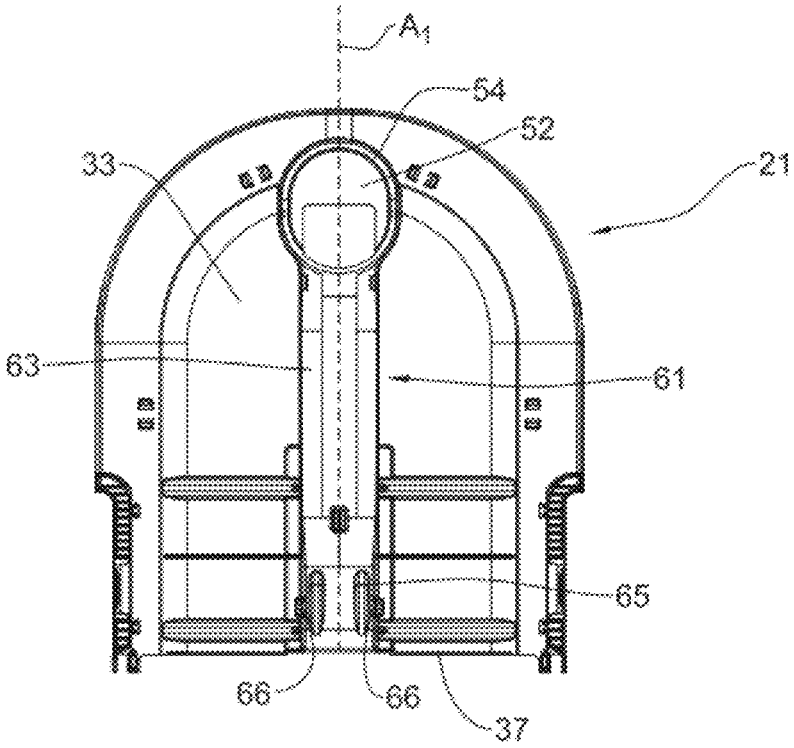
FIG. 7C is a bottom view of the upper torso support of the bouncer.
Figure 7D:
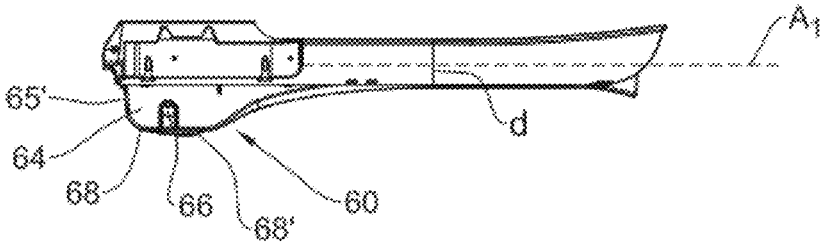
FIG. 7D is a side view of the upper torso support of the bouncer.
Figure 7E:
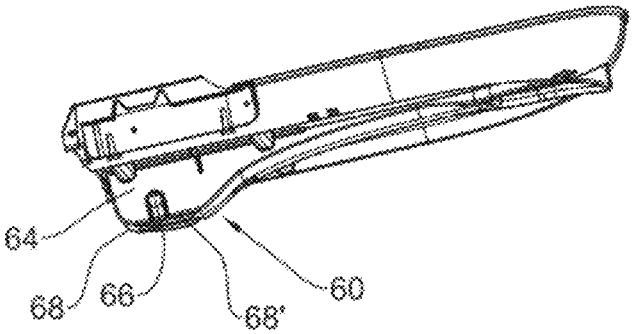
FIG. 7E is a side perspective view of the upper torso support of the bouncer.
Figure 8A:
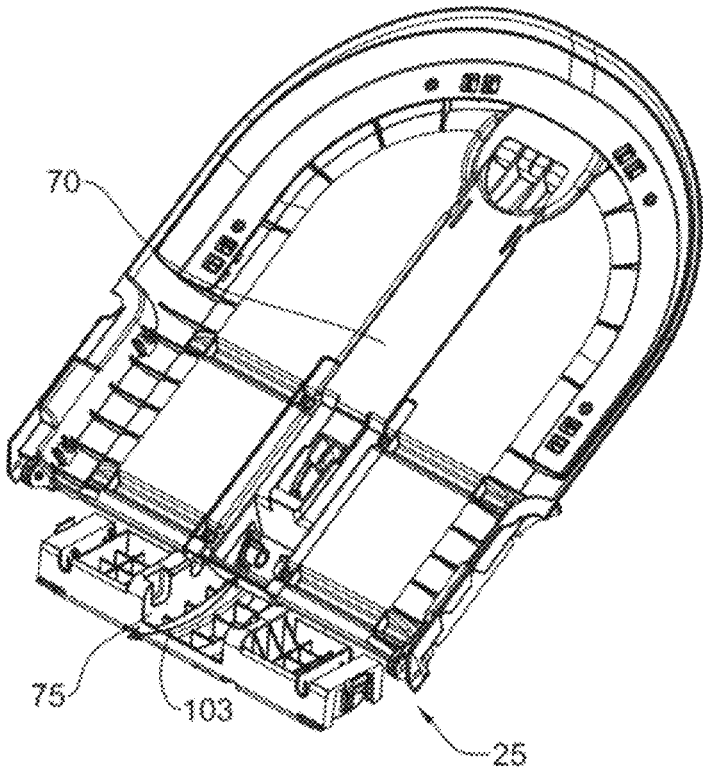
FIG. 8A is a top perspective view of the upper torso support of the bouncer together with a converting mechanism.
Figure 8B:
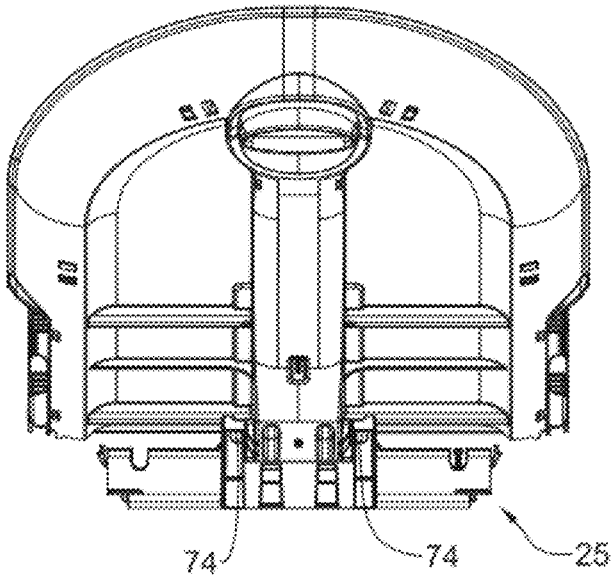
FIG. 8B is a bottom view of the upper torso support of the bouncer together with a converting mechanism.

With reference to FIGS. 7A to 8B, the upper torso support 21 is provided with a longitudinal channel 61 extending substantially along the entire length thereof (i.e. along axis $A_1$). The channel 61 comprises a handle lever receiving portion 63 and a positioning receptacle 65 terminating at a positioning receptacle base 65' (FIG. 7A). The channel 61 is depressed, i.e. projects downwardly with respect to the bottom surface 33 of the upper torso support 21 (FIG. 7D), and is of a non uniform depth d (FIGS. 7D and 7E), measured perpendicularly to the top surface 31 of the upper torso support 21 and gradually decreasing along axis $A_1$ towards the base 37 of the upper torso support 21, between a grip receiving portion 52, defined by an edge 54 at its one end and the positioning receptacle 65, as its other end. An interior surface 60 of the channel 61 is provided with a partition wall 67 extending between the channel inner walls 69, partitioning between the handle receiving portion 63 and the positioning receptacle 65. The interior surface 60 is further provided with a handle spring protrusion 62, to be slidingly received within a corresponding spring opening 80 within the handle lever 70, as described below with reference to FIGS. 9A and 9B. At the exterior side walls 64 thereof the positioning receptacle 65 is formed with two side holes 66 (FIGS. 7D and 7E) for slidingly receiving therein locking pins 74 of a positioning mechanism 75, as described below (FIGS. 8A to 11C). At an exterior surface 68 thereof, the positioning receptacle 65 is formed with reinforcing ribs 68' configured to facilitate the sliding of the receptacle within the housing 71.

The channel 61 is shaped so as to receive therein a handle lever 70 (FIGS. 9A, 9B, 11A and 11B), which constitutes a part of the converting mechanism 25.

At the top surface 31 of the upper torso support 21 the positioning receptacle 65 of the channel 61 is covered by a cover plate 61', (FIG. 5A).

Figure 1A:
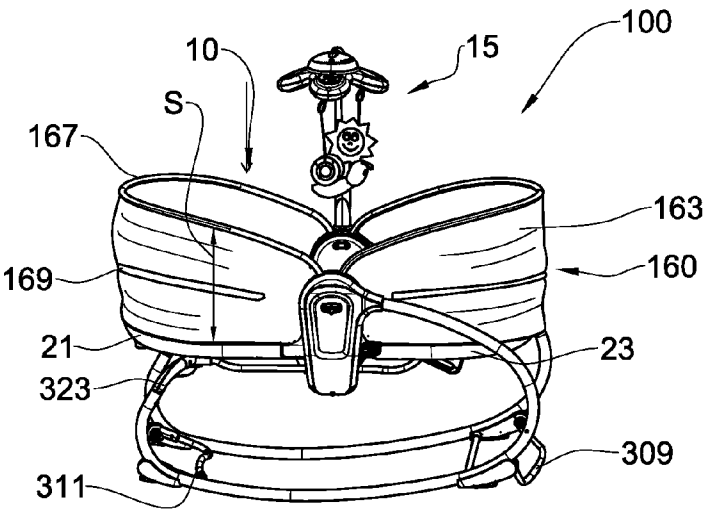
FIG. 1A is a side view of a bouncer comprising a seat in accordance with the presently disclosed subject matter in the planar position.

Referring now to FIGS. 9A to 11C, there is shown in detail the converting mechanism 25 configured for facilitating converting the seat 10 between its different positions. In the particular example, the converting mechanism 25 allows the seat assembly 20 to be configured in three positions, namely a planar position (FIG. 1A), a first angular position (FIG. 1B) and a second angular position (FIG. 1C).

It should be appreciated that the converting mechanism 25 can be configured for converting the seat 10 to assume more than the above three positions, i.e. more distinct angular positions.

As described below with reference to FIGS. 9A to 11C, the converting mechanism 25 comprises the handle lever 70, the positioning mechanism 75 and the housing 71.

The handle lever 70 (FIGS. 9A, 9B, 11A and 11B) is shaped to conform the shape of the channel 61 of the upper torso support 21, in which the handle lever 70 is slidingly received, so that it can freely slide between the channel inner walls 69 of the channel 61 along axis $A_1$. In particular, the handle lever 70 is configured to be slidingly displaced within the handle receiving portion 63 of the channel 61. A grip 83 is configured at an upper end of the handle lever 70, and a lower portion 85, shaped so as to conform with the shape of the receptacle 65.

Figure 11A:
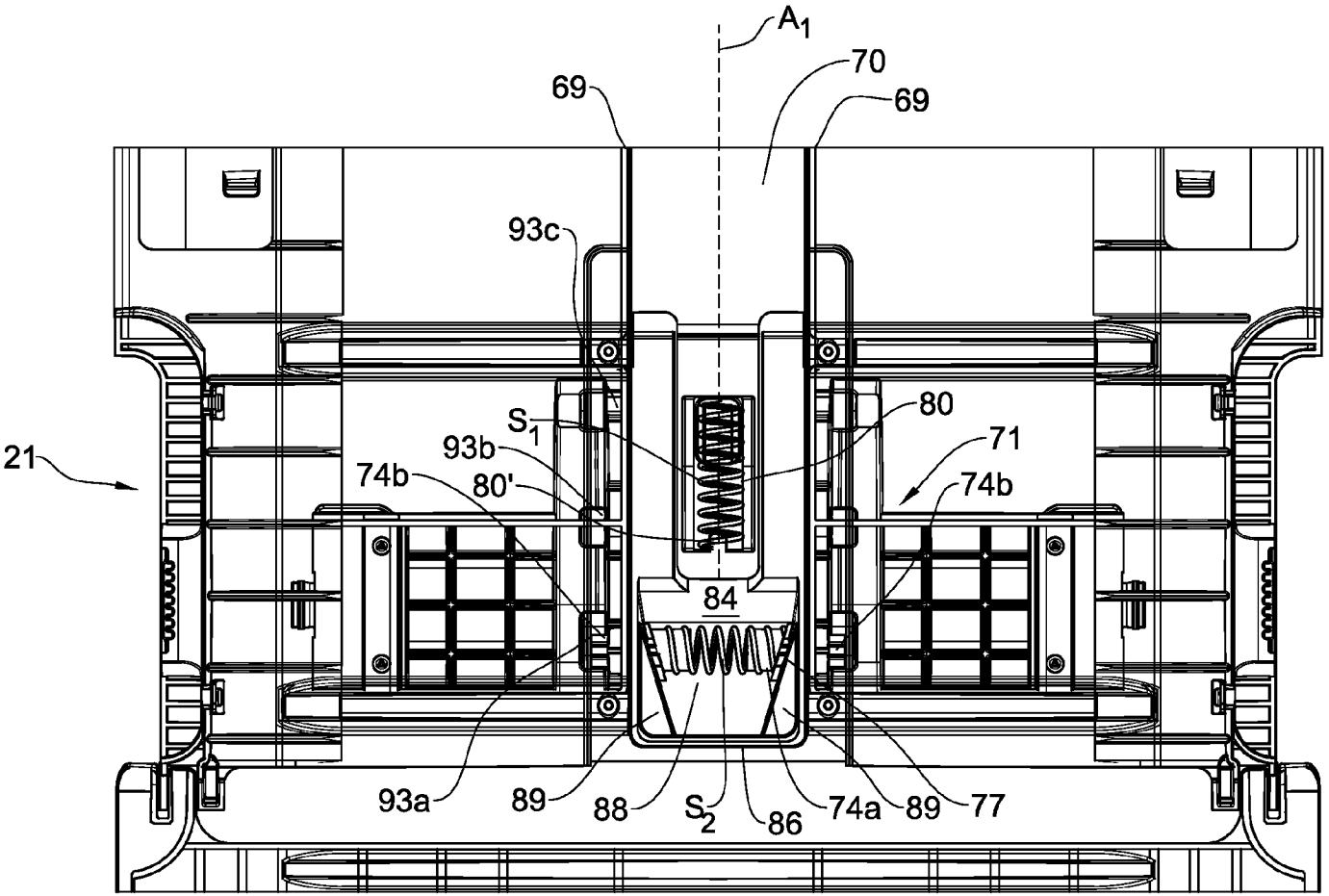
FIGS. 11A and 11B show two stages of operation of the converting mechanism.
Figure 11B:
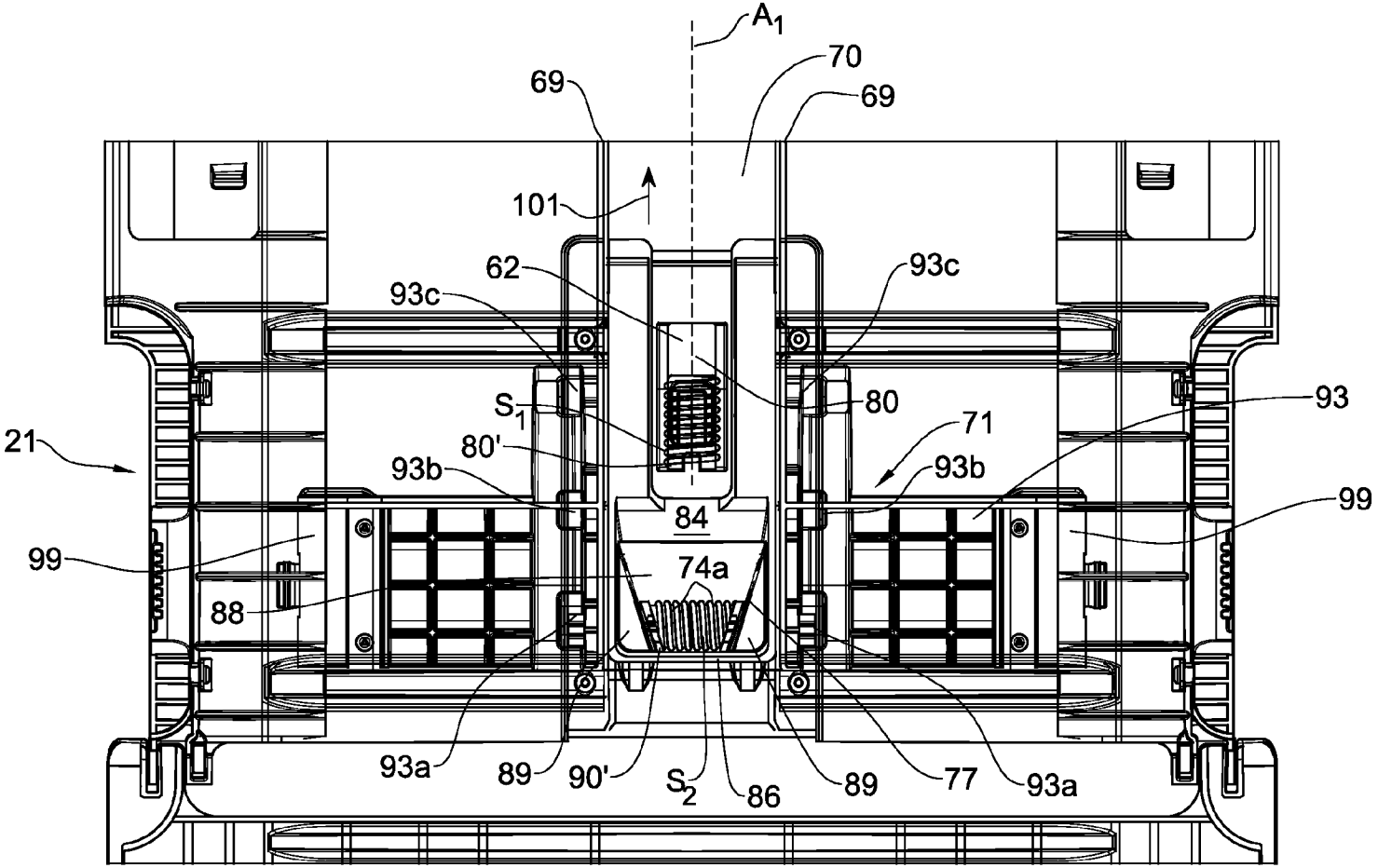

The handle lever 70 is fitted with the spring opening 80 (FIGS. 9A to 9C, 11A and 11B) and with a spring seat 80', so that when the handle lever 70 is received within the channel 61 a handle spring $S_1$ (FIGS. 11A and 11B) is fitted between the spring seat 80' and the handle spring protrusion 62 of the channel 61 (FIG. 11B).

Figure 11C:
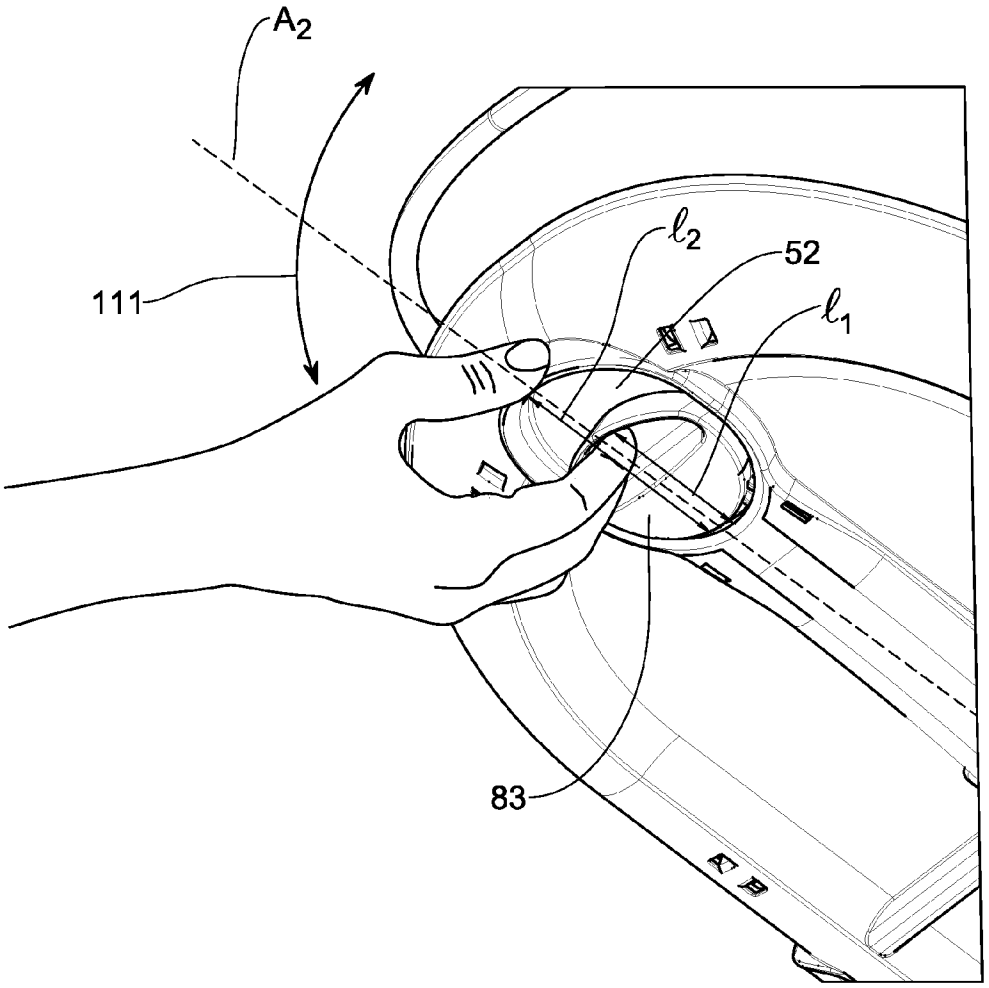
FIG. 11C illustrates how the handle lever of FIGS. 9A and 9B is pulled by a user.

The handle lever 70 is configured to slide along the channel 61 between two end positions: a normal position (FIG. 11A), in which the handle spring $S_1$ is in its relaxed state, i.e. the spring seat 80' is maximally spaced from the handle spring protrusion 62 along axis $A_1$, and a pulled position (FIG. 11B), in which the handle lever 70 is maximally outwardly pulled, by means of an external force (applied, for example by a user, as shown in FIG. 11C), compressing thereby the spring $S_1$ against the handle spring protrusion 62.

With reference to FIG. 11C, the handle lever 70 is received within the channel 61, such that the grip 83 is positioned within the grip receiving portion 52 on the bottom surface 33 of the upper torso support 21, which is exposed so as to allow the access to the grip 83. The grip 83 has a length $l_1$ smaller than a length $l_2$ of the grip receiving portion 52, so that the grip 83 can slide along axis $A_2$ within the grip receiving portion 52.

Figure 9A:
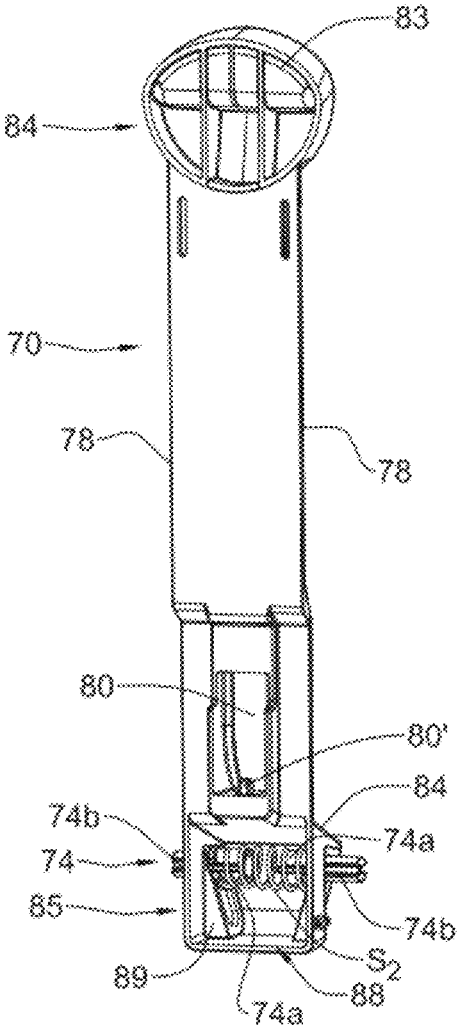
FIGS. 9A and 9B area front perspective and a bottom view, respectively of a handle lever of the converting mechanism of FIGS. 8A and 8B.
Figure 9B:
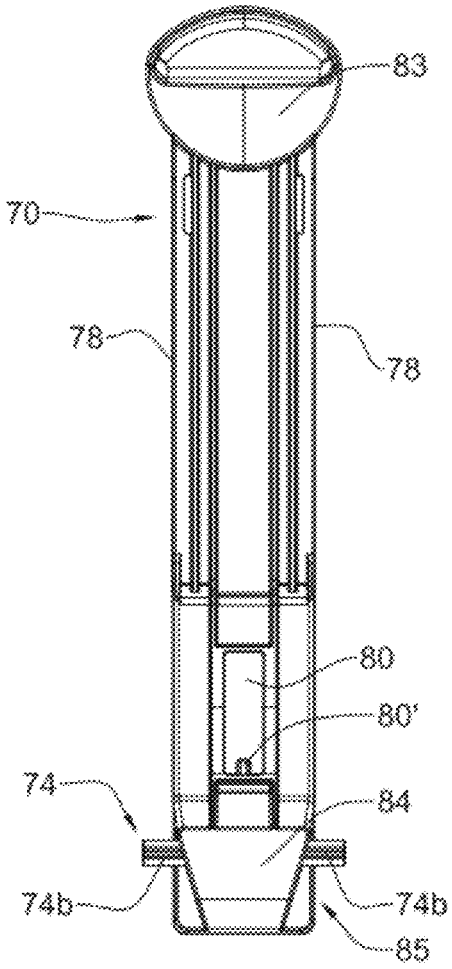
Figure 9C:
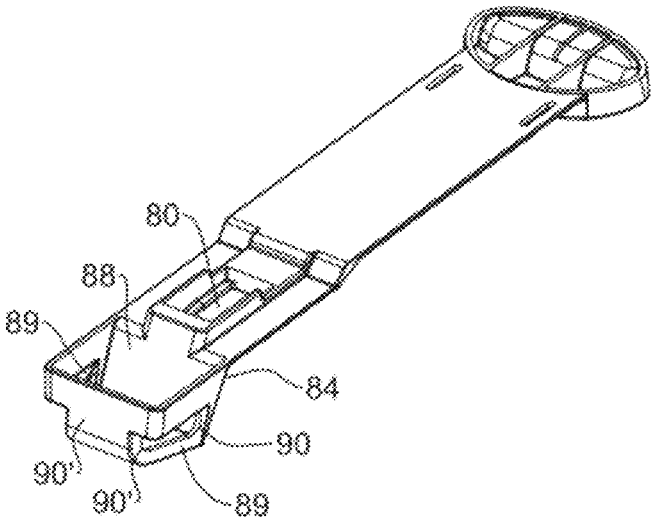
FIG. 9C is a top perspective view of the handle lever of FIGS. 9A and 9B.
Figure 10A:
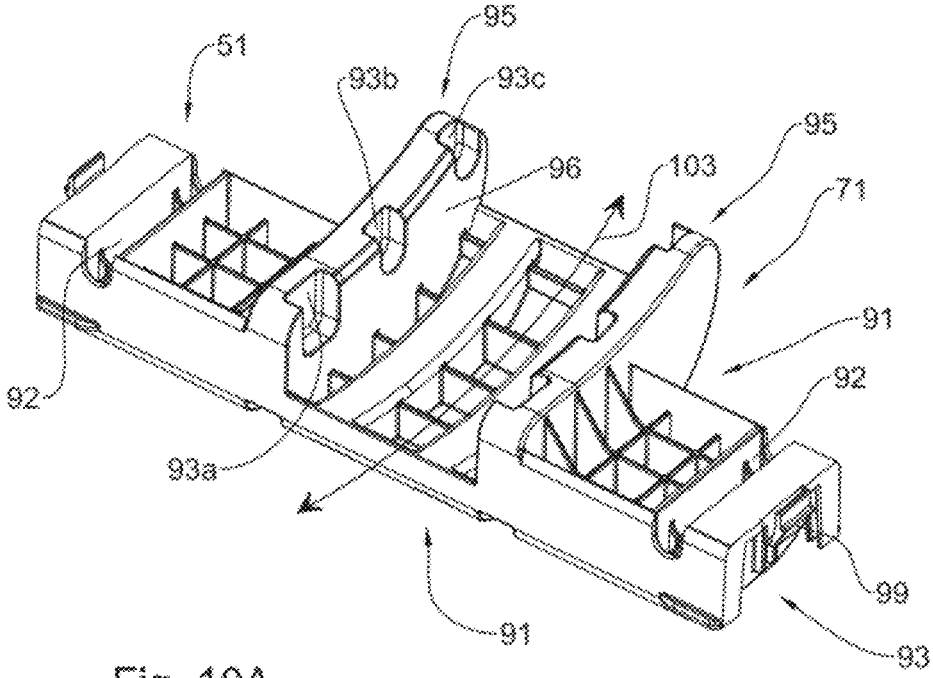
FIGS. 10A and 10B are a top perspective and a front view, respectively of a housing of the converting mechanism of FIGS. 8A and 8B.
Figure 10B:
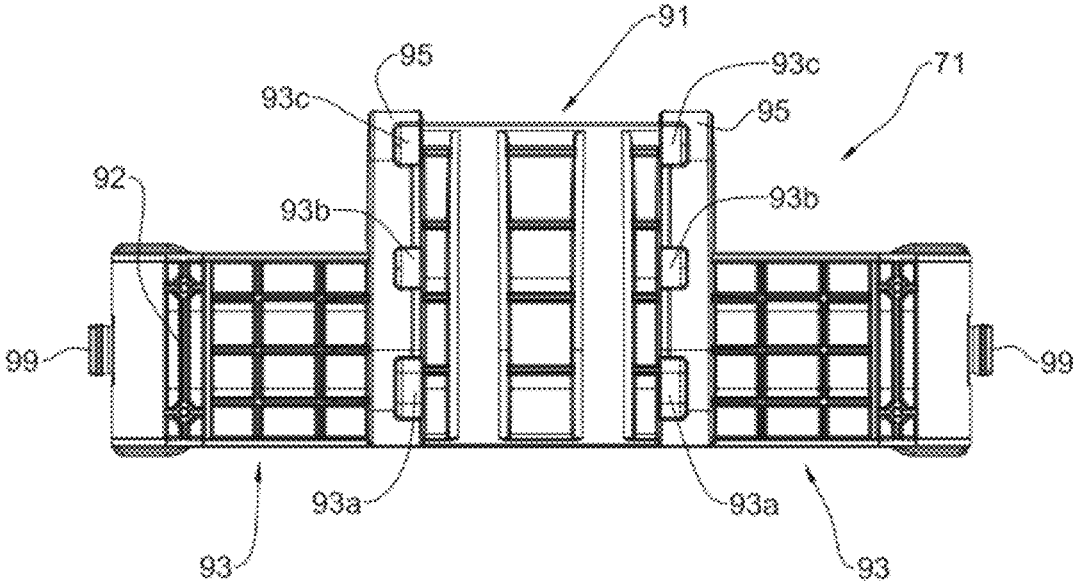

The lower portion 85 comprises a cavity 88 (enlarged in FIG. 9C) formed between slanted cavity walls 89, each wall 89 formed with a longitudinal recess 87 extending between an upper end 90 and a lower end 90' (FIG. 9C). The slanted cavity walls 89 define a trapezoid within the cavity 88, having its upper base 84 facing the partition wall 67 of the channel 61 and its lower base 86 facing the positioning receptacle base 65'.

The positioning mechanism 75 comprises two locking pins 74 and a positioning spring $S_2$ fitted therebetween (FIG. 11A). The locking pins 74 have inner portions 74*a* fitted with a stopper 77 (best seen in FIGS. 11A and 11B) and outer portions 74*b*, shaped so as to fit the longitudinal recesses 87 of the lower portion 85 (best seen in FIG. 9A). The locking pins 74 are received within the recesses 87 so that the inner portions 74*a* extend within the cavity 88 of the lower portion 85 with the spring $S_2$ is fitted on the pins 74 (FIG. 11A), such that the outer portions 74*b* are normally biased away one from the other to extend through the longitudinal recesses 87 and through the side holes 66 of the receptacle 65 to protrude outwardly therefrom, as shown in FIG. 11A. The stoppers 77 restrict the lateral movement of the locking pins 74 outwardly to the cavity 88 of the lower portion 85.

With reference to FIGS. 2B, 6, 10A and 10B, the housing 71 constitutes a rigid hinge connector between the upper torso support 21 and the seat supporting structure 27. The housing 71 comprises a central arched portion 91 extending between two side brackets 95 separating between the central arched portion 91 and two side portions 93. The central arch portion 91 is shaped so as to slidingly receive the receptacle 65 of the longitudinal channel 61 of the upper torso support 21 (FIG. 8B) Each bracket 95 comprises an inner wall 96 facing the exterior side walls 64 of the receptacle 65, while the receptacle 65 slides therealong between discreet positions, each associated with a respective position of the seat 10, as described below.

In particular, each of the inner walls 96 of the bracket 95 comprises three pairs of opposite recesses 93*a*, 93*b* and 93*c*, shaped so as to arrest therein the outer portions 74*b* of the locking pins 74 of the positioning mechanism 75.

Figure 6:
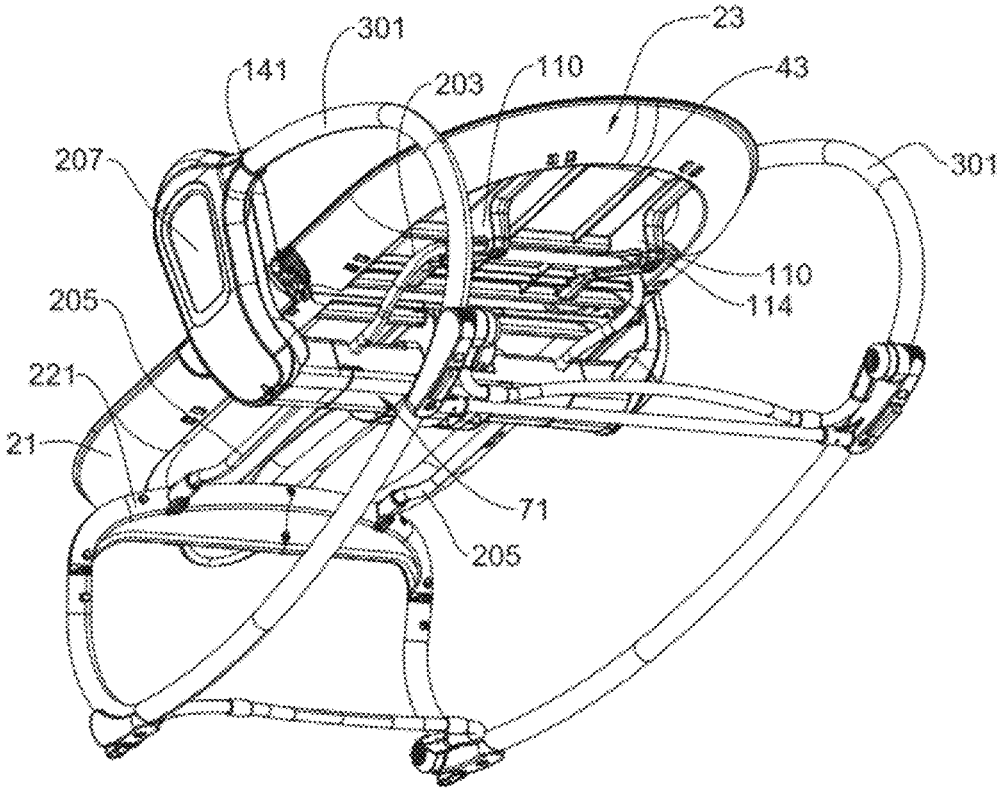
FIG. 6 is a bottom perspective view of the bouncer of FIG. 5A.

The side portions 93 of the housing 71 comprise two rod receiving channels 92 (FIGS. 10A to 11B) for receiving therein the rods 205 of the bottom supporting frame 201 (FIGS. 2B and 6).

At their external ends 99 the side portions 93 are fixed to the side supports 207, as described below with reference to FIGS. 13 to 15.

The operation of the converting mechanism 25 will be now explained in detail. As detailed above, the converting mechanism 25 configured for converting the seat assembly 20 between its different positions, by means of the handle lever 70, the positioning mechanism 75 and a housing 71.

Referring back to FIGS. 11A and 11B, converting the seat assembly 20 between its different discrete positions takes place in two main stages, namely, a pulling stage (FIG. 11B), and a positioning stage (FIG. 11A). The pulling stage allows the sliding of the handle lever 70 along the channel 61 of the upper torso support 21, and the positioning stage allows the sliding (i.e. linear and pivotal displacement) of the receptacle 65 of the lower torso support 21 along the central arched portion 91 of the housing 71 between predefined discreet positions, each position being associated with one of the positions of the seat 10, as defined by the location of the recesses 93*a* to 93*c*.

At the pulling stage, the handle lever 70 is outwardly pulled (i.e. by pulling the grip 83) against the biasing effect of the spring $S_1$ along axis $A_1$ (as shown by an arrow 101 in FIG. 11B), displacing the handle lever 70 from its normal (locked) position (FIG. 11A) to its pulled position (FIG. 11B). In the pulled position of the handle lever 70 is displaced so that the locking pins 74 are positioned adjacent the lower ends 90' of the recesses 87 (FIG. 11B) decreasing the distance therebetween and compressing the spring $S_2$. In this position, the locking pins 74 are retracted and do not protrude outwardly from the side holes 66 of the receptacle 65, allowing free sliding of the receptacle 65 together with the lower portion 85 of the handle lever 71, along the central arched portion 91 of the housing 71, as shown by an arrow 103 in FIGS. 3A and 10A.

Figure 4A:
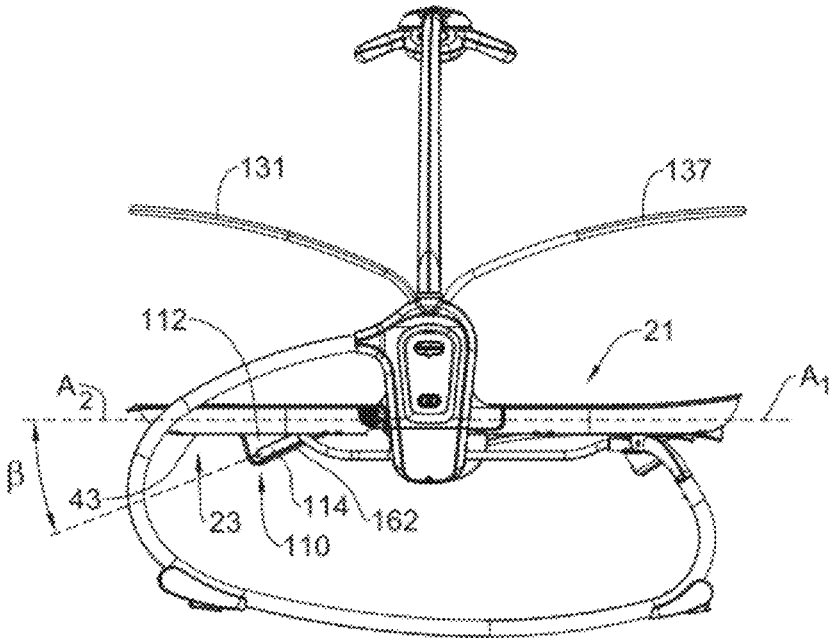
FIGS. 4A and 4B are side views of the bouncer in the angular position and the planar position, respectively.
Figure 4B:
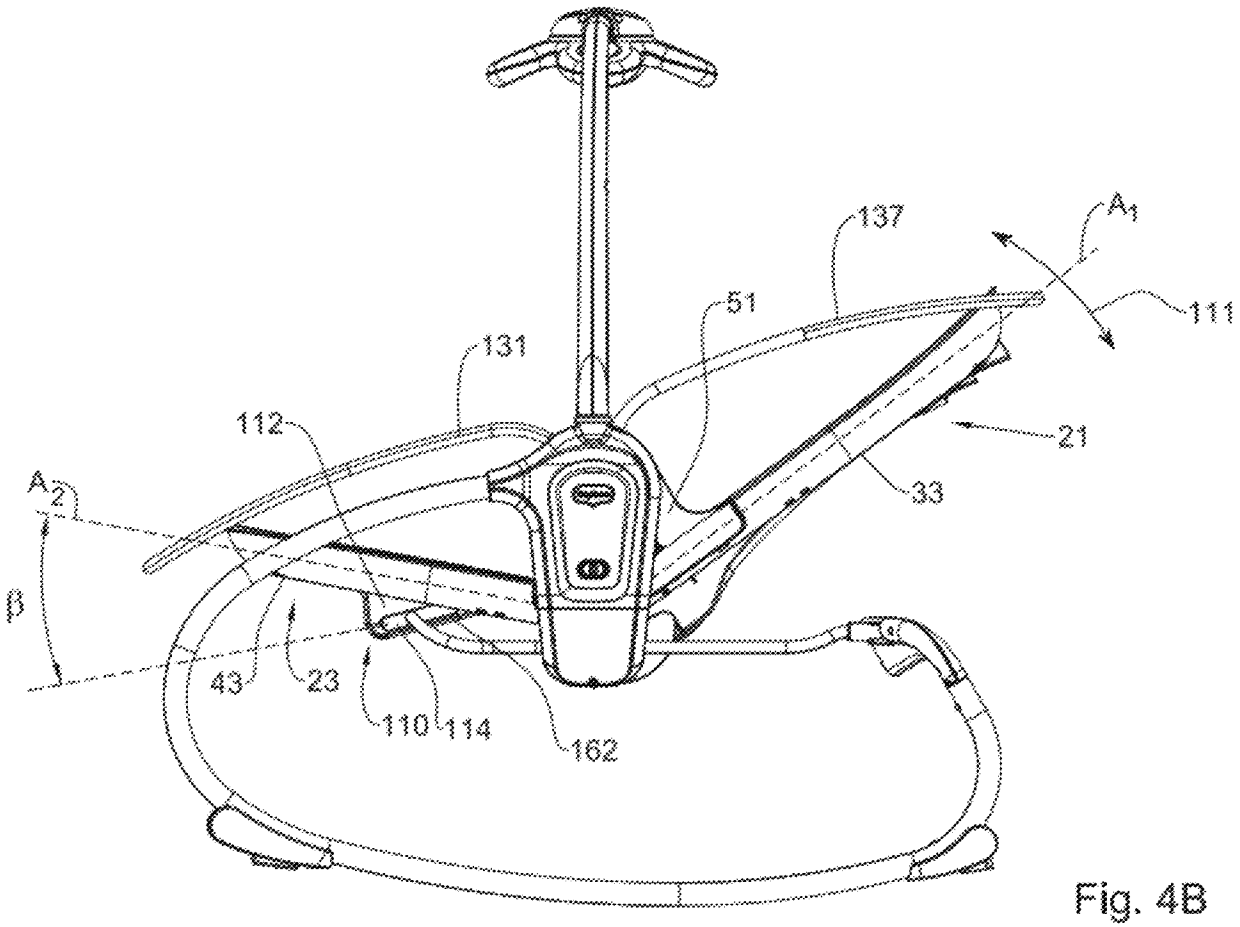

In the positioning stage, while the handle lever 70 is held by pulling the grip 83 (FIG. 11E) and the locking pins 74 are inwardly retracted against the spring $S_2$, the seat 10 can be converted between its different positions. In particular, the receptacle 65 of the channel 61 can slide back and forth along the central arched portion 91 of the housing 71, by applying an external force to the upper torso support 21 (preferably at the area of the grip receiving portion 52, as shown in FIG. 11C), in a tilting sense, as represented by an arrow 111 (FIGS. 4B and 11C).

As indicated above, the inner walls 96 of the brackets 95 comprise three pairs of opposite recesses 93*a*, 93*b* and 93*c* (FIGS. 10A to 11B), each associated with a discrete position of the seat 10. In particular, the recess 93*a* is associated with the planar position (FIG. 1A), the recess 93*b* is associated with the first angular position (FIG. 1B) and the recess 93*c* is associated with the second, most acute angular position (FIG. 1C). The arrangement is such that when the locking pins 74 are brought to a position in which their outer portions 74*b* face one of the pairs of recesses 93*a*, 93*b* or 93*c* and the grip 83 is released so that no external force is applied to the handle lever 70, the lower portion 85 of the handle lever 71 returns downwardly under the biasing effect of the spring $S_1$ towards the positioning receptacle base 65', the inner portions 74*a* of the locking pins 74 are not pressed against the spring $S_2$ anymore, and the outer portions 74*b* of the rods return to protrude outwardly from the receptacle 65 into one of the corresponding pairs of recess 93*a*, 93*b* or 93*c*, in accordance with the desired position of the seat 10 (FIG. 11C).

With reference now being made to FIGS. 4A, 4B, 12A and 12B, the bottom surface 43 of the lower torso support 23 comprises two restricting elements 110 each composed of an angled portion 112 extending from the lower surface 43 and a cover element 162 configured for being fixed to the angled portion 112 so as to form a closed restricting path 114 extending between a path first end 118 and a path second end 120 and forming an angle 13 (FIGS. 4A and 4B) with respect to axis $A_2$.

Figure 12B:
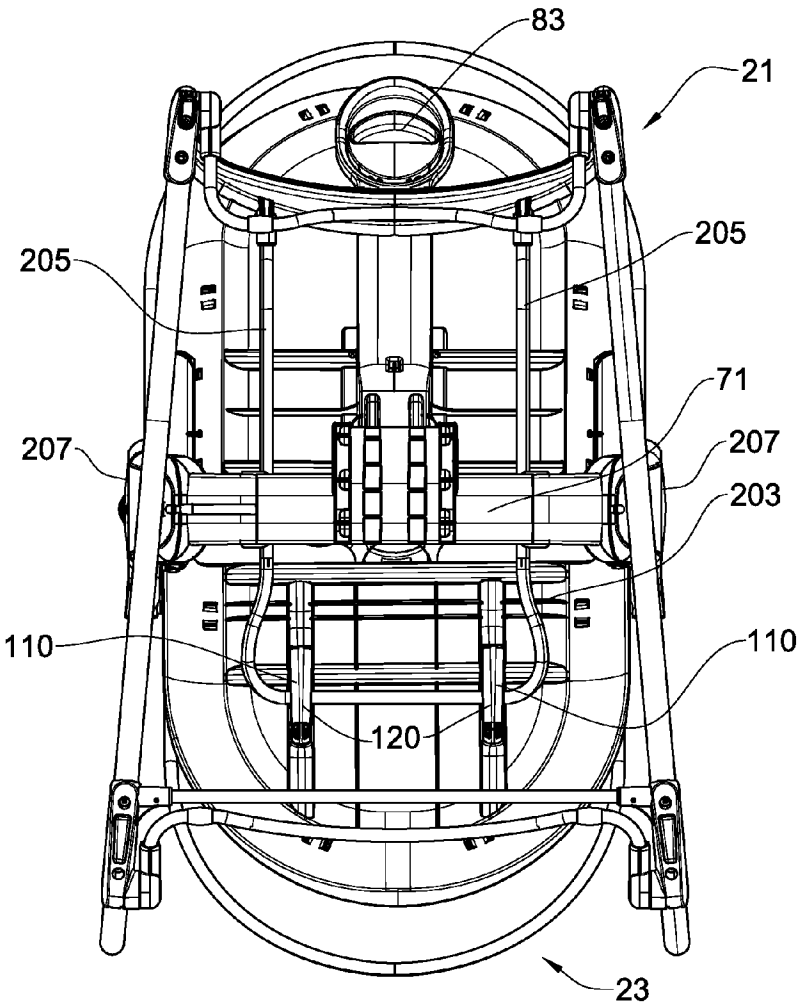
FIGS. 12A and 12B are a bottom view showing the bouncer of FIGS. 3A and 3B in the planar position and the angular position, respectively.
Figure 12A:
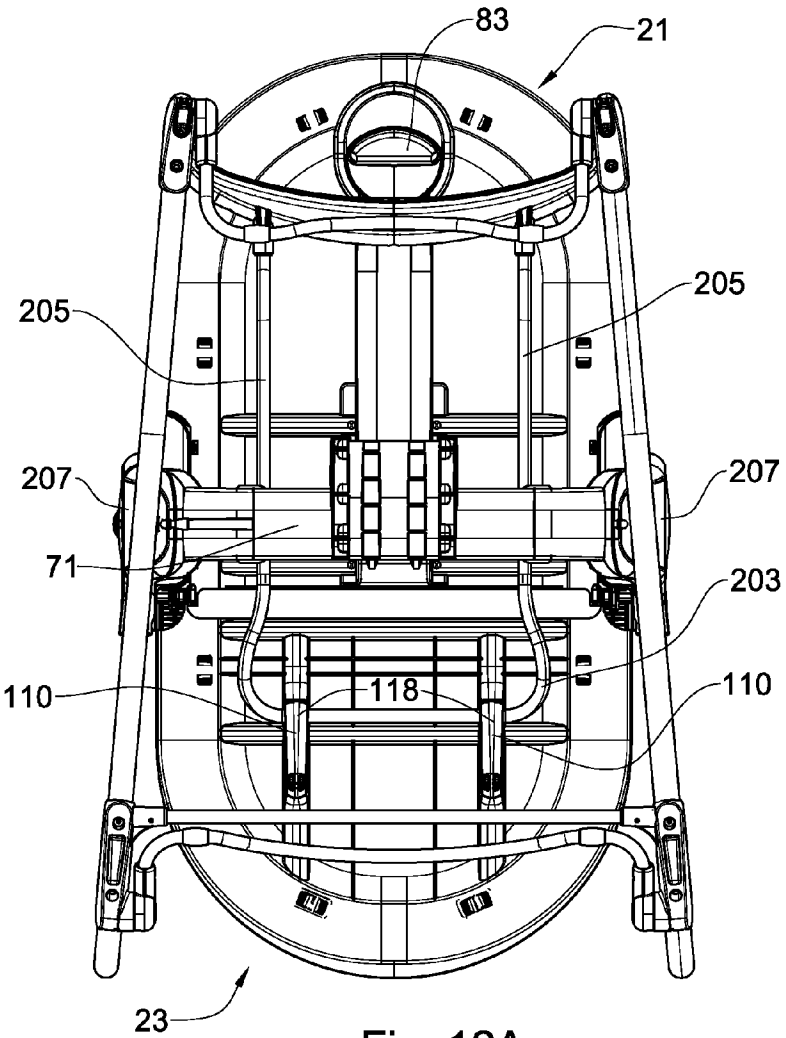

The restricting path 114 is configured for slidingly receiving therein the transverse portion 203 of the seat supporting structure 27, so that the sliding thereof is limited by the path ends 118 and 120 (FIGS. 12A and 12B).

The arrangement is such that when an external force is applied to the upper torso support 21, due to it being articulated to the lower torso support 23, the lower torso support 23 slides with respect to the transverse portion 203, when the latter is received within the path 114. In particular, the position of the restricting elements 110 of the upper torso support 21 with respect to the transverse portion 203 within the path 114 is associated with the position of the seat 10: when the seat 10 is in its planar position (FIG. 1A) the transverse portion 203 is adjacent to the path first end 118 (FIG. 12A), when the seat 10 is in its first angular position (FIG. 1B), the transverse portion 203 is situated between the path first end 118 and the path second end 120, and when the seat 10 is in its second angular position (FIG. 1C), the transverse portion 203 is adjacent the path second end 120 (FIG. 12B).

Figure 13:
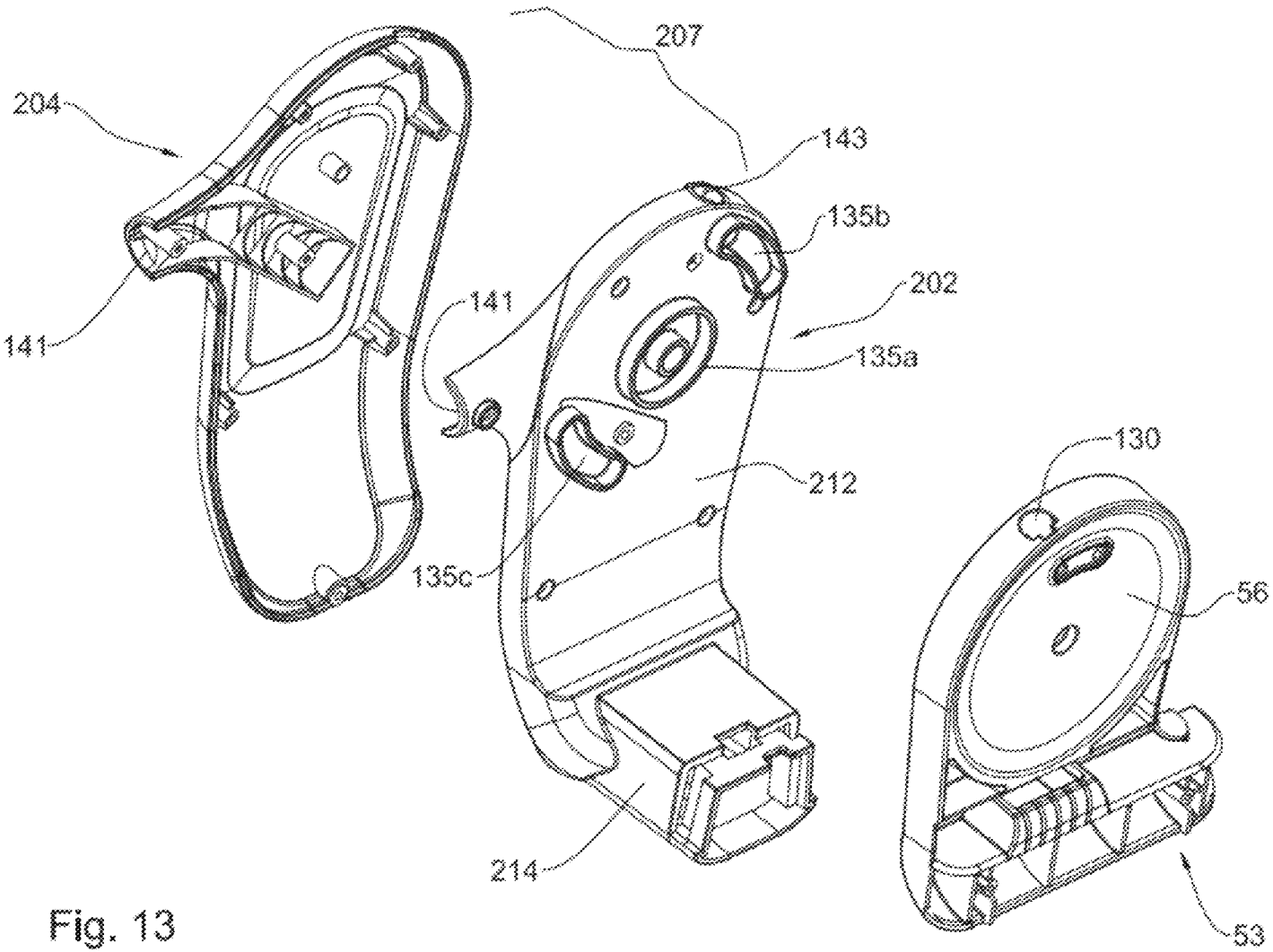
FIGS. 13 and 14 are exploded views illustrating the pivoting bracket and side support of the bouncer.
Figure 14:
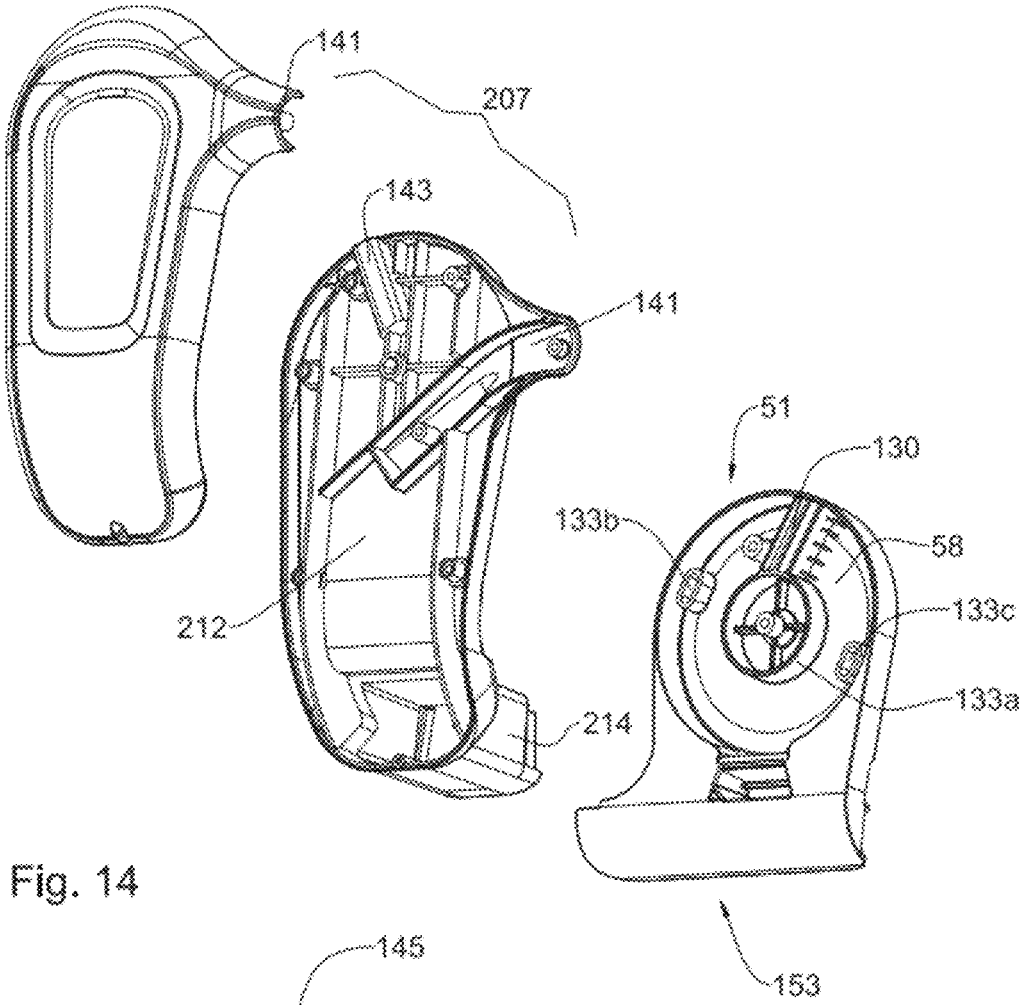
Figure 15:
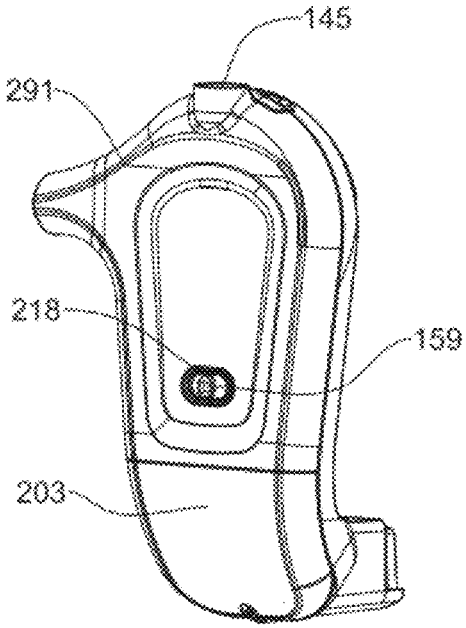
FIG. 15 illustrates a modification of a side support according to the presently disclosed subject matter.

Reference is now being made to FIGS. 13 to 15, showing the pivoting brackets 51 and the side supports 207.

Upwardly projecting from the edges 35 of the upper torso support 21 near its base 37, there are oppositely disposed a pair of pivoting brackets 51, each shaped and sized for pivotal coupling to a respective inner shell 202 of the side support 207.

It is noted that the pivoting brackets 51 can be integral with of fixedly attached to the upper torso support 21.

An outside face 58 of the pivoting bracket 51 is configured with a pivot hub 133*a* for pivotal arresting with a corresponding hub 135*a* formed at the inside face 212 of the shell 202, and a plurality of projections 133*b* and 133*c* are disposed about a path of rotation and configured for limited displacement within corresponding grooved 135*b* and 135*c* of the shell 202.

Figure 3A:
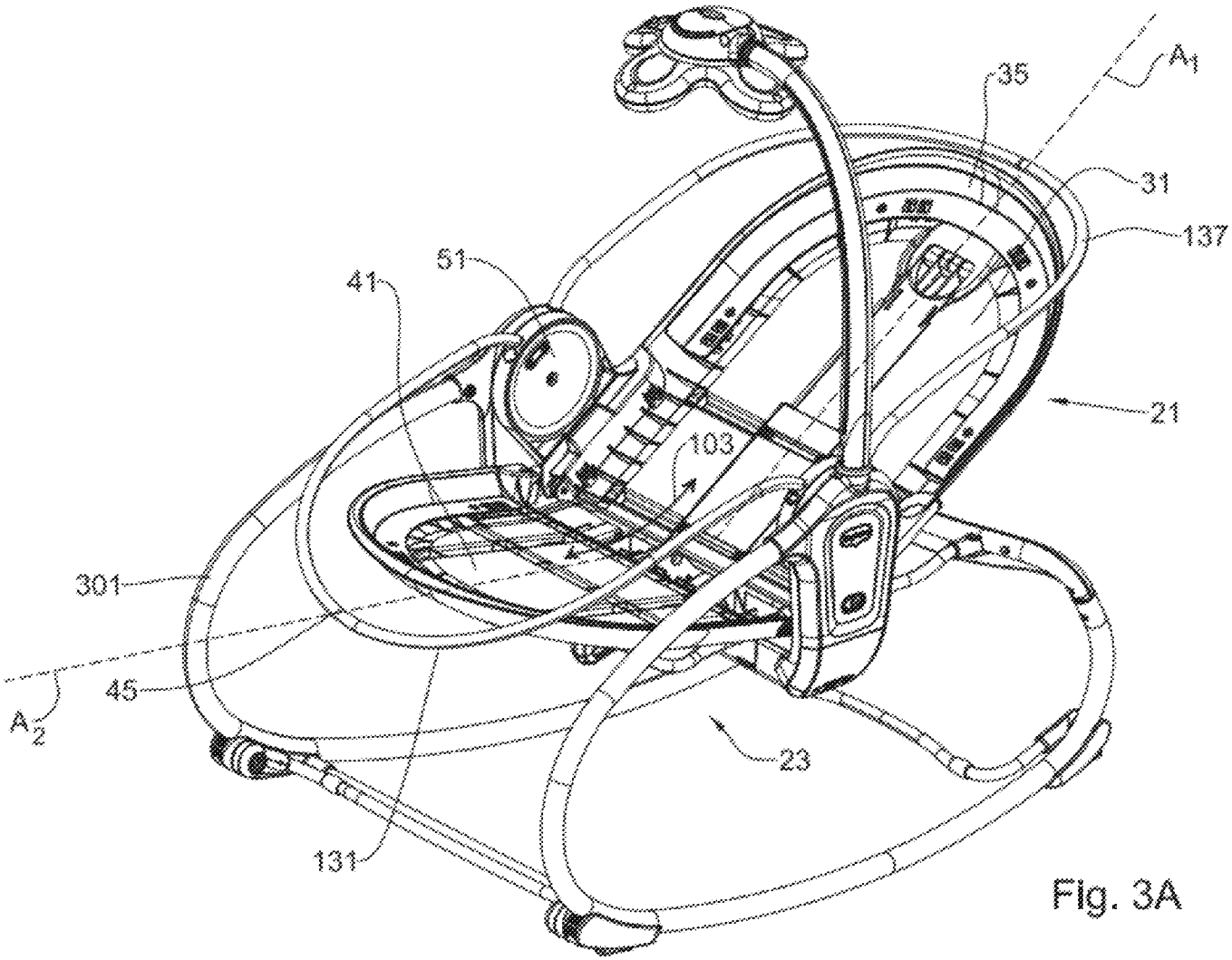
FIGS. 3A and 3B are top perspective views of the bouncer, shown without the fabric cover in the angular and the planar positions, respectively.
Figure 3B:
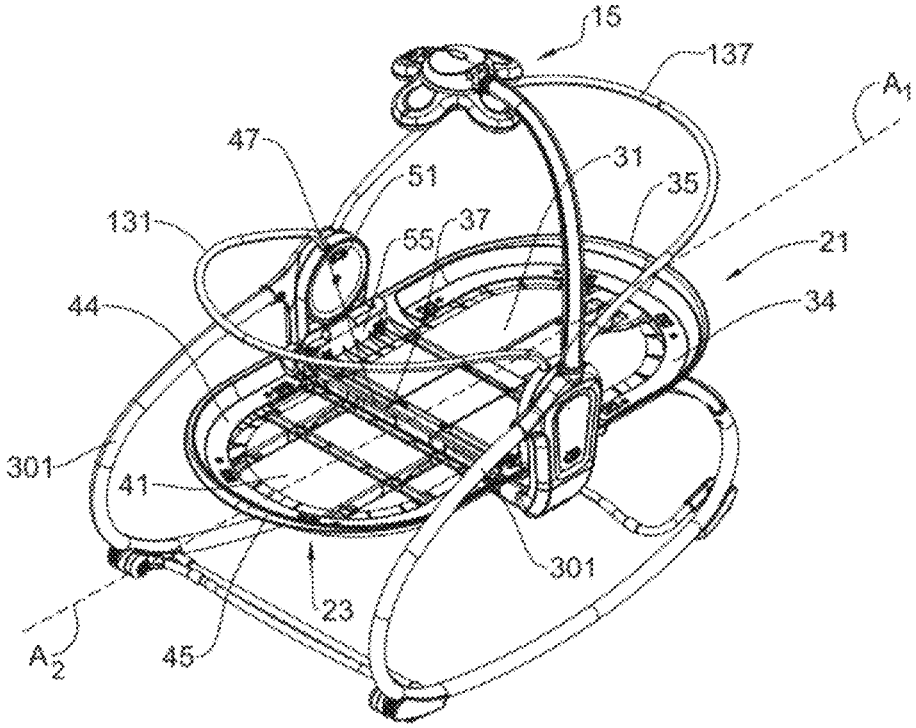

The brackets 51 are configured for pivoting with respect to the side supports 207 between two end positions associated with the end positions of the seat assembly 20. In particular, in the planar position, the bracket 51 is fully coaxial with the side support 207 (FIGS. 3B and 4B), while in any angular position, the bracket 51 is slanted with respect to the side support 207 (FIGS. 3A and 4A).

The side supports 207 constitute part of the supporting structure 27 configured for being coupled, directly or indirectly to the base structure 11.

The inner shells 202 further comprise inwardly extending lower portions 214, shaped so as to fixedly support the external ends 99 of the side portions 93 of the housing 71.

The side supports 207 are further provided with a receptacle 143 configured for detachably receiving therein a rear fabric supporting frame 137 (FIGS. 3A to 4B). In addition, the side support 207 is provided with a second receptacle 141 (also shown in FIGS. 5A and 6) for detachably receiving therein a main frame 301 of the base structure 11.

As shown in FIG. 15, one of the side supports 207 is further configured with a toy arch receiving channel 145 for detachably receiving therein a toy arch 151 of the toy assembly 15 (FIG. 2A), which is formed by both the outer shell 204 and the inner shell 202 (FIG. 15). Alternatively, the channel 145 can be formed in only one of the shells (not shown). When the toy assembly is not in use, it can be detached from the seat 10 and the toy arch receiving channel 145 can be covered by a channel plug 147 (FIG. 2A).

In addition, the side supports 207 may be further configured for being fitted with a toy control mechanism 157, e.g. electric motor (not seen), received within a mechanism seat 216 (not seen) formed between the inner and the outer shells 202 and 204. In addition, the outer shell 204 is formed with an operating switch 159 of the control mechanism 157.

Referring back to FIGS. 2A and 3A to 4B, the bouncer 100 further comprises a fabric assembly 13 composed of the front 131 and the rear 137 fabric supporting frames.

The front fabric supporting frame 131 is a U-shaped bar configured to be detachably received within the inner hollow channels 130 of the pivoting brackets 51, so as to pivot together with the brackets 51 with respect to the side support 207, when the seat assembly 20 is converted between its different positions.

The rear fabric supporting frame 137 is a U-shaped bar configured to be detachably received within the receptacles 143 of the side support 207 and, consequently, remains stationary when the seat assembly 20 is displaced between its different positions.

The fabric cover 160 (FIGS. 1A to 1C) comprises a seat pad 161 (FIGS. 1B and 1D) configured for fitting over the upper torso support 21 and the lower torso support 23 by annular fabric arresting members 34 and 44, as described above. The fabric cover further comprises a side wall 163, which, according to one example, can be detachably attached to the seat pad 161 and/or directly to the upper torso support 21 and the lower torso support, thus rendering it to be easily removed and attached for maintenance or for use without the side wall 163. The side wall 163 is provided with a circumferential rim 167 (FIGS. 1A to 1E) about its top edge in which the front 131 and rear 137 fabric supporting frames are received. The fabric cover 160 is further provided with at least one wire segment 169 (FIGS. 1A and 1E), providing an additional support to the side wall 163 in the planar position.

The arrangement is such that at the planar position (FIGS. 1A and 1E) a distance s (FIGS. 1A and 1E) between the upper torso support 21 and the lower torso support 23 and the front 131 fabric supporting frame and the rear fabric supporting frame 137, respectively, is maximal. In this position, the side wall 163 serves as a bassinet wall.

Figure 1B:
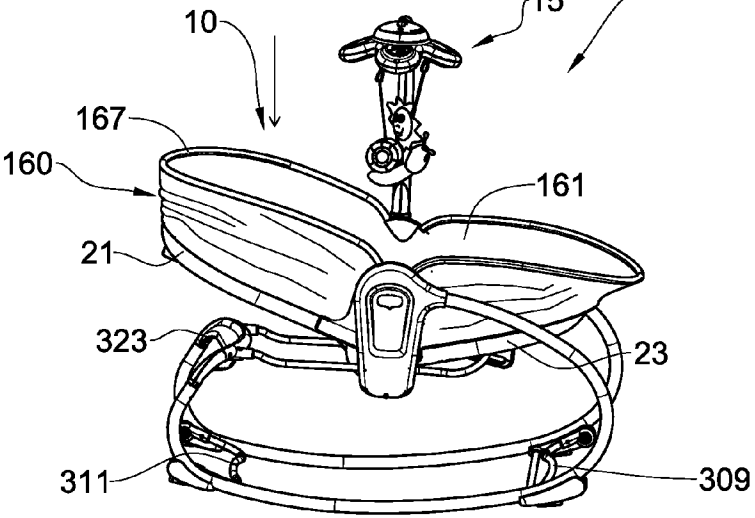
FIGS. 1B and 1C are side views of the bouncer in two different angular positions.
Figure 1C:
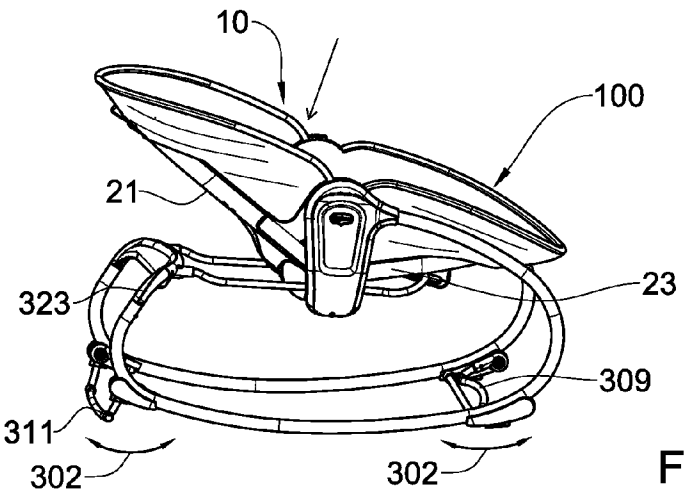
Figure 1D:
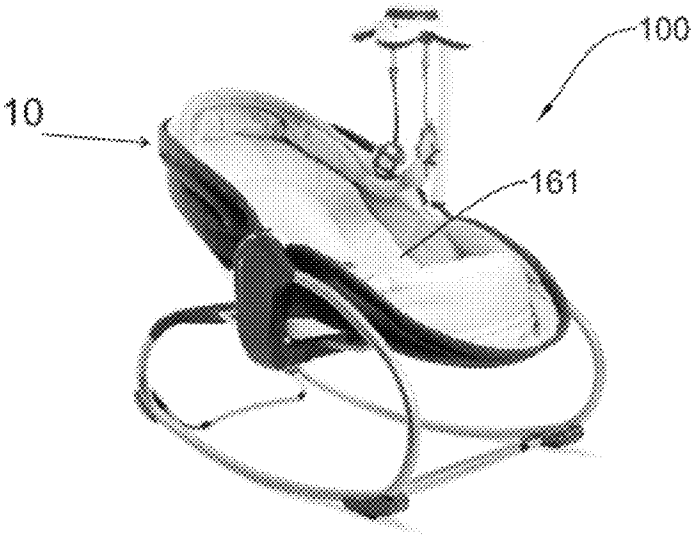
FIGS. 1D and 1E are top perspective views of the bouncer in an angular position and the planar position, respectively.
Figure 1E:
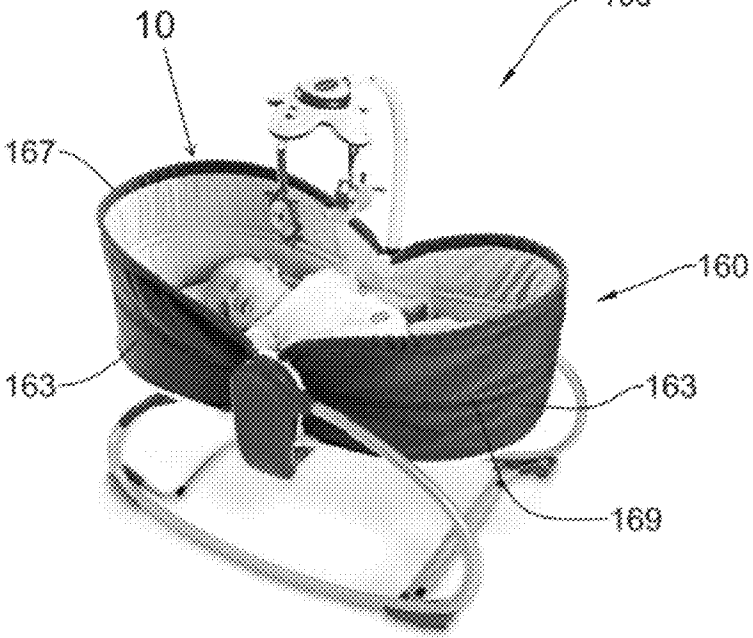

When the seat 10 is converted from the planar position to an angular position, the distance s between the upper torso support 21 and lower torso support 23 the corresponding front frame 131 and rear frame 137 shortens, thereby the fabric therebetween folds accordingly, enlarging thereby a field of view of the infant (FIGS. 1B, 1C and 1D).

The fabric cover 160 is constructed such as to allow the conversion of the bouncer 100 between the different positions without limiting the motion of the seat 10, and to further allow a free access to parts that may have to be disassembled or disconnected.

Referring back to FIG. 2A, the bouncer 100 further comprises the base structure 11. The base structure 11 comprises the main frame 301 having two front springy/elastic arched bars 305 at its front end, detachably receivable within the receptacles 141 of the side supports 207, the rear bars 307 at its rear end, detachably attached to the back rest member 221 of the supporting structure 27, directly or by means of a couple of rear connectors 323 (FIGS. 1A to 1C).

The springy arched bars 305 provide the bouncer 100 with both bouncing and rocking effect. Both effects are controllable. In particular, the main frame 301 may be provided with stoppers 309 and/or 311 (FIGS. 1A to 1C) pivotable as shown by arrows 302 (FIG. 1C), between a folded state allowing back and forth movement of the bouncer 100, and a deployed state, in which the rocking movement is restricted. The bouncing effect can be provided by the springy bars 305 allowing bouncing movement, may also be controlled and restricted by any suitable means.

The base structure 11 may further comprises an additional front bar 306, extending between the springy bars 305 (FIG. 2A) and/or side bars 304, extending the between the side supports 207 and the main frame 301 (not shown).

All the base structure elements and the fabric supporting frames are typically made of a lightweight plastic material, such as structural nylon. The stoppers 309 and 311 may constitute an integral part of the main frame or may be separate elements made of, for example, a synthetic rubber such as thermoplastic elastomer (TPE).

In accordance with the presently disclosed subject matter the seat 10 can constitute a part of any kind of bouncer, a chair, any kind of car safe seat, a swing, a stroller or a plane seat/bassinet, all can be stationary or portable. The other subassemblies, namely, a fabric assembly, a base structure and a toy assembly, can be detachably attached to the seat by means described above or other means, as long as the seat can be converted between different positions thereof.

Figure 16A:
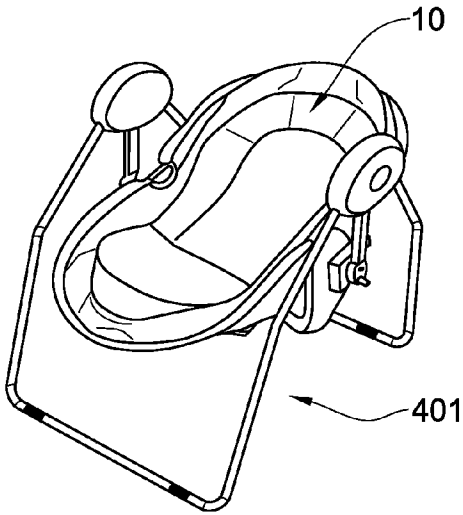
FIGS. 16A to 17 illustrate different examples of a base structure used in conjunction with a seat, according to the presently disclosed subject matter.
Figure 16B:
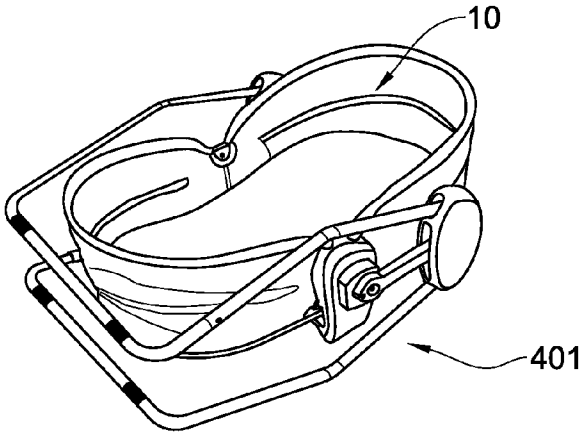
Figure 16C:
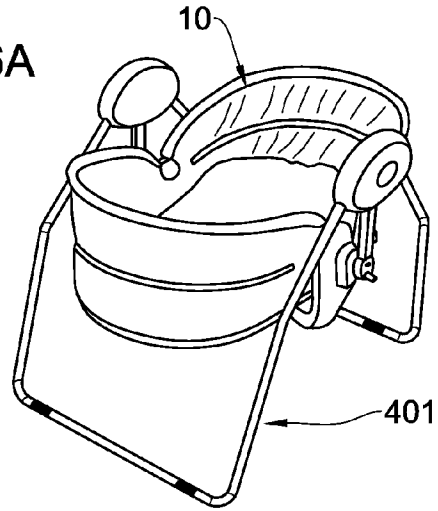
Figure 17:
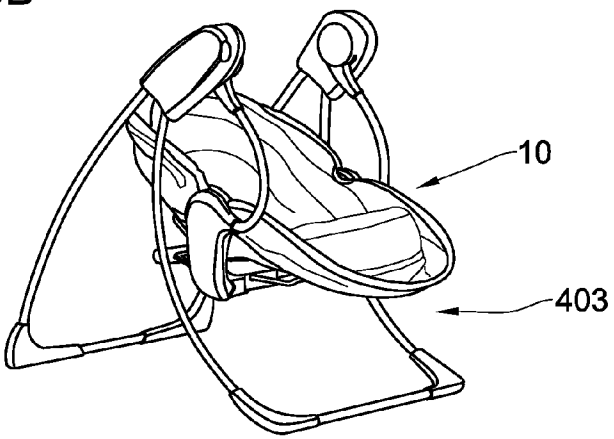

FIGS. 16A to 17 show the seat 10 attached to bases 401 and 403, having a configuration different from that of the base 11, although operation of the seat 10 remains substantially the same.

Figure 18C:
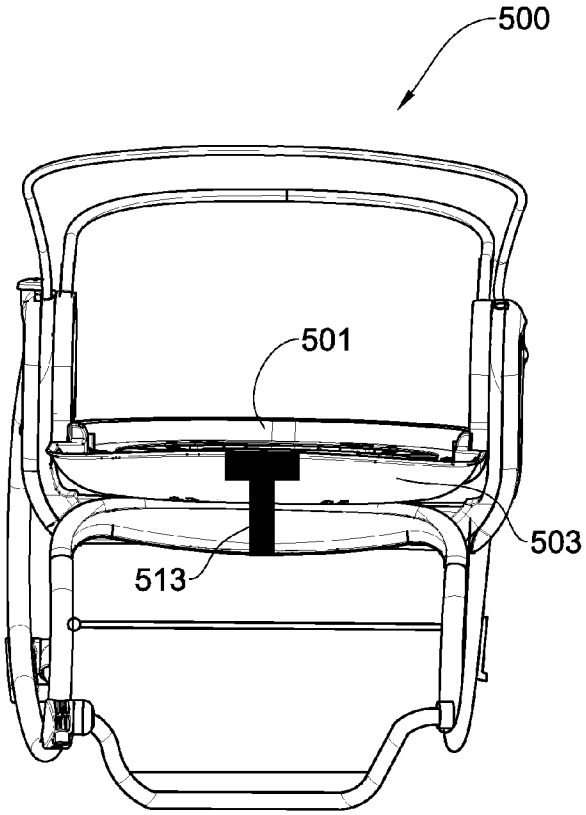
FIGS. 18A to 18C illustrate a bouncer comprising another example of a seat with fixators, according to the presently disclosed subject matter.
Figure 18A:
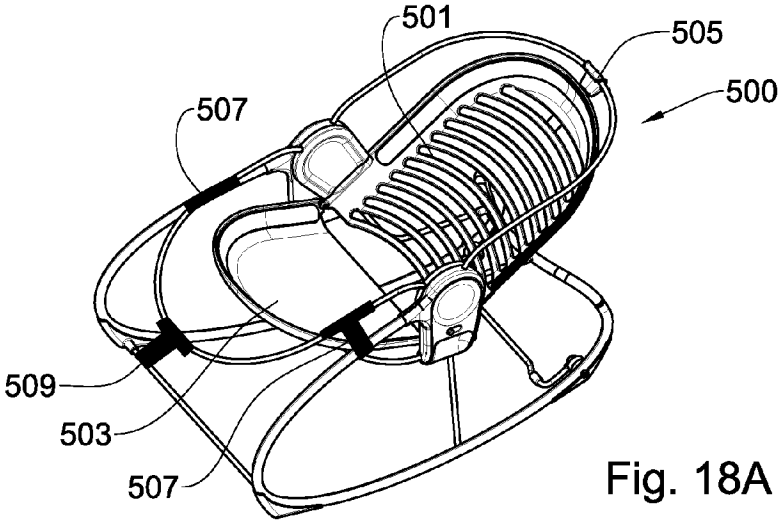
Figure 18B:
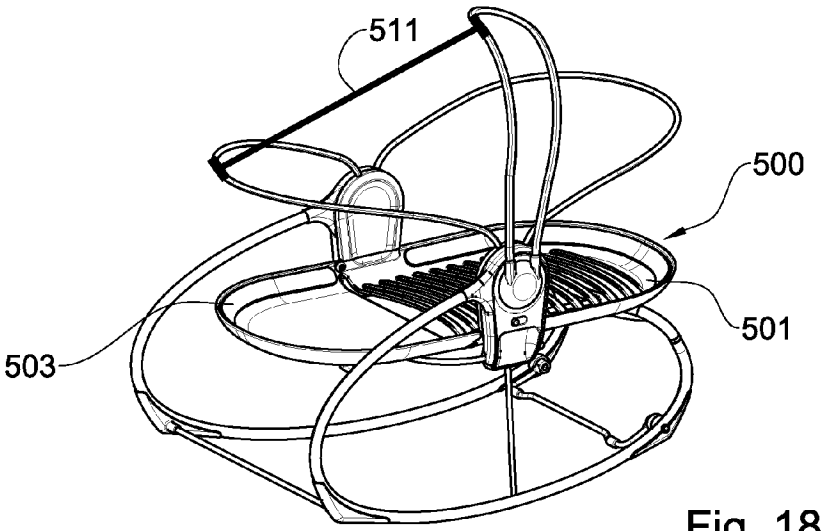

With reference to FIGS. 18A to 18C, there is schematically illustrated a bouncer 500 in which the converting mechanism (not shown) can be the assembly 25 as described above or other converting mechanism allowing converting an upper torso support 501 and the lower torso support 503 between at least an angular position (FIG. 18A) and a planar position (FIGS. 18B and 18C).

The bouncer 500 can be provided with different fixators 505, 507, 509, 511 and 513 arresting the upper torso support and/or the lower torso support to other sub-assemblies, i.e. the base structure or the frame assembly.

The fixator may be hook like elements and/or comprise attaching means such as Velcro strips, snaps etc.

Those skilled in the art to which this invention pertains will readily appreciate that numerous changes, variations, and modification can be made without departing from the scope of the invention, *mutatis mutandis.*

The invention claimed is:

1. An infant seat, comprising:

an upper torso support;

a lower torso support pivotally articulated to the upper torso support;

a seat supporting structure, at least one of the upper torso support or the lower torso support is pivotally articulated to the seat supporting structure; and a converting mechanism configured for converting the infant seat between at least an angular position in which the upper torso support is inclined with respect to the lower torso support, and a planar position in which the upper torso support and the lower torso support are substantially co-planar, the converting mechanism defining a plurality of discrete positions each of which is associated with at least one of the angular position or the planar position of the infant seat, the converting mechanism further including a first portion associated with the upper torso support and a second portion fixed to the seat supporting structure, the first portion configured to be slidingly displaced with respect to the second portion when the seat is converted between different positions thereof.

2. The infant seat according to claim 1, wherein the first portion is a handle lever slidingly received within the upper torso support and the second portion is a housing fixedly attached to the seat supporting structure.

3. The infant seat according to claim 2, wherein the handle lever is associated with a locking mechanism configured for arresting the seat in one of the angular position or the planar position, thereby preventing the seat from unintentionally converting to another position.

4. The infant seat according to claim 3, wherein the upper torso support is formed with a receiving channel extending longitudinally along at least a portion thereof and configured for slidingly receiving therein the handle lever.

5. The infant seat according to claim 4, wherein the seat is configured for converting between different positions thereof by first slidingly displacing the handle lever along the receiving channel of the upper torso support so as to release the locking mechanism and then slidingly displacing the upper torso support with respect to the seat supporting structure so as to bring the seat to the desired position.

6. The infant seat according to claim 5, wherein the locking mechanism comprises a pair of locking pins and a plurality of pairs of recesses within the housing, each of the plurality of pairs of recesses is configured for arresting the pair of the locking pins, so that when the pair of locking pins are spaced from the recesses the handle lever can be displaced along the receiving channel and the upper torso support can be slidingly displaced with respect to the seat supporting structure, and when the seat is brought to the desired position the pins are released to be arrested within a corresponding pair of recesses associated said desired position of the seat.

7. The infant seat according to claim 1, wherein the upper torso support comprises two generally opposite pivoting brackets articulated thereto and, in turn, pivotally attached to the seat supporting structure.

8. The infant seat according to claim 1, wherein the lower torso support is configured for sliding displacement with respect to the seat supporting structure.

9. The infant seat according to claim 8, wherein the sliding of the lower torso support is caused by the pivotal displacement of the upper torso support with respect to the seat supporting structure due to the pivotal articulation between the upper torso support and the lower torso support.

10. The infant seat according to claim 1, wherein the upper torso support engages the lower torso support only at areas of pivotal articulation therebetween.

11. The infant seat according to claim 1, wherein the lower torso support comprises a limiting arrangement configured for limiting the sliding displacement of the lower torso support with respect to the seat supporting structure.

12. The infant seat according to claim 1, further comprising a fabric frame assembly configured to be detachably attached thereto.

13. The infant seat according to claim 12, wherein the fabric frame assembly comprises a front fabric frame, configured to be displaced in correspondence to the displacement of the upper torso support with respect to the seat supporting structure and a rear fabric frame, stationary with respect to the seat supporting structure.

14. The infant seat according to claim 13, wherein the fabric frame assembly is spaced from the upper and the lower torso support at least when the seat is in its planar position.

15. The infant seat according to claim 14, wherein the fabric frame assembly constitutes together with a fabric cover fitted thereover fabric walls for wrapping the seat.

16. The infant seat according to claim 1, further configured for converting into one or more distinct angular positions, each defined by a different angle between the upper torso support and a lower torso support.

17. The infant seat according to claim 1, configured for detachably attaching to a base structure, the base structure configured for providing the infant seat with a motion effect and a mechanism for controlling the motion effect.

18. The infant seat according to claim 1, constituting part of a cradle, a bouncer, a chair, a car safe seat, a swing, a stroller, or a plane seat/bassinet.

* * * * *